US007315317B2

(12) United States Patent
Kitamura et al.

(10) Patent No.: US 7,315,317 B2
(45) **Date of Patent: *Jan. 1, 2008**

(54) PRINTER

(75) Inventors: Norikazu Kitamura, Wakayama (JP); Motoharu Habata, Wakayama (JP); Takayuki Hasegawa, Wakayama (JP)

(73) Assignee: Noritsu Koki Co., Ltd., Wakayama-shi (JP)

( * ) Notice: Subject to any disclaimer, the term of this patent is extended or adjusted under 35 U.S.C. 154(b) by 176 days.

This patent is subject to a terminal disclaimer.

(21) Appl. No.: 11/085,273

(22) Filed: Mar. 22, 2005

(65) Prior Publication Data

US 2005/0212890 A1 Sep. 29, 2005

(30) Foreign Application Priority Data

Mar. 26, 2004 (JP) ..... 2004-091066
Apr. 27, 2004 (JP) ..... 2004-131232

(51) Int. Cl.
*B41J 2/315* (2006.01)
*B41J 2/325* (2006.01)

(52) U.S. Cl. ..... 347/171; 347/219

(58) Field of Classification Search ..... 347/171, 347/174, 176, 183, 218–219; 400/120.04
See application file for complete search history.

(56) References Cited

U.S. PATENT DOCUMENTS 5,743,663 A * 4/1998 Imai ..... 400/120.04
2001/0019352 A1 9/2001 Miyazaki
2003/0146971 A1 8/2003 Mogi
2004/0189783 A1* 9/2004 Mogi ..... 347/218

FOREIGN PATENT DOCUMENTS

JP 8-174876 A 7/1996
JP 9-99572 A 4/1997
JP 9-267500 A 10/1997
JP 2001-246769 A 9/2001

* cited by examiner

*Primary Examiner*—K. Feggins
(74) *Attorney, Agent, or Firm*—Smith Patent Office

(57) ABSTRACT

A printer includes a conveyance mechanism capable of conveying a long recording medium in a first direction from a supply unit storing therein the recording medium, toward an image recording unit capable of recording a color image on the recording medium, and in a second direction reverse to the first direction, with opposing the recording medium to the image recording unit; and a cutting unit capable of cutting the recording medium between the image recording unit and the supply unit. The conveyance mechanism is controlled to convey the recording medium in the first direction until a leading edge of the recording medium reaches a position distant in the first direction from the image recording unit, and then convey the recording medium in the second direction; and to form a slack portion of the recording medium being conveyed in the second direction, between the image recording unit and the cutting unit. The image recording unit is controlled to record frames of color images on the recording medium being conveyed in the second direction by the conveyance mechanism. The cutting unit is controlled to cut the recording medium being conveyed in the second direction.

13 Claims, 9 Drawing Sheets

PRINTER

BACKGROUND OF THE INVENTION

1. Field of the Invention

The present invention relates to a printer for recording color images on a recording medium.

2. Description of Related Art

Various techniques are known in relation to printers each of which can record a color image on a recording medium. For example, JP-A-8-174876 discloses a one-path type color thermal printer having three thermal heads that can record colors of yellow, magenta, and cyan, respectively. The three thermal heads cooperate with each other to record a color image on a recording paper unwound from a recording paper roll and being conveyed in a paper feed direction.

JP-A-9-99572 discloses a three-path type color thermal printer. In this printer, a portion of a heat-sensitive color recording paper of a length corresponding to one frame, unwound from a recording paper roll, is conveyed forward so as to be opposite to one thermal head, and then conveyed backward. In the backward conveyance, a yellow image is recorded on the portion of the recording paper. Afterward, such forward and backward conveyances of the recording paper are repeated alternately. A magenta image is recorded in the second backward conveyance. A cyan image is recorded in the third backward conveyance.

JP-A-2001-246769 discloses a one-path type color thermal printer having three thermal heads for yellow, magenta, and cyan. A recording paper unwound from a recording paper roll is conveyed in a paper feed direction. After completion of preparation for printing, the recording paper is conveyed backward. In the backward conveyance, one frame of color image is recorded on the recording paper. In this printer, after the one frame of color image is recorded, the recording paper is again conveyed in the paper feed direction and then the portion of the recording paper on which the one frame of color image has been recorded is cut off at the rear end of the color image. After the portion of the recording paper on which the one frame of color image has been recorded is discharged, the remaining portion of the recording paper, which has completed preparation for printing, is again conveyed backward to record thereon the next one frame of color image.

In the printer disclosed in JP-A-8-174876, a color image can be recorded, even without conveying the recording paper in both the forward and backward directions, with conveying the recording paper in only one direction. In this printer, however, if the three thermal heads are pressurized onto the recording paper in the order of the thermal heads the printing position of which the recording paper has reached, the image to be recorded may be deteriorated due to variation of load in the conveyance of the recording paper. For this reason, such a printer is designed so as to start recording a color image after all the three thermal heads are pressurized onto the recording paper. As a result, any image can not be recorded in a region near the leading edge of the recording paper between the most upstream thermal head and the most downstream thermal head in the conveyance direction.

Contrastingly, the printer disclosed in JP-A-9-99572 or JP-A-2001-246769 can record a color image even in a region near the leading edge of the recording paper. Thus, the recording paper is hardly wastefully consumed. In addition, in the printer disclosed in JP-A-2001-246769, because all the three thermal heads are being pressurized onto the recording paper while the recording paper is conveyed backward, the image to be recorded is hardly deteriorated due to variation of load in the conveyance of the recording paper.

In the printer disclosed in JP-A-9-99572, however, the conveyance of the recording paper in either of the forward and backward directions must be repeated three times for recording one frame of color image. Similarly in the printer disclosed in JP-A-2001-246769, the conveyance of the recording paper in either of the forward and backward directions must be carried out every time when one frame of color image is recorded. Therefore, when a plurality of frames of color images are recorded with such a printer, the conveyance of the recording paper in either of the forward and backward directions must be repeated many times. More specifically, in the case of recording m frames of color images (m: an integer of two or more), the recording paper must be conveyed in either of the forward and backward directions 3m times in the printer disclosed in JP-A-9-99572, and m times in the printer disclosed in JP-A-2001-246769.

In the printer disclosed in JP-A-9-99572 or JP-A-2001-246769, a pair of conveyance rollers are disposed between the recording paper roll and the thermal heads. The conveyance direction of the recording paper is changed to one of the paper feed direction and the backward direction by switching over the driving direction of the pair of conveyance rollers. Therefore, in the case of the printer disclosed in JP-A-9-99572, the driving direction of the pair of conveyance rollers must be switched over (6m−1) times. In the case of the printer disclosed in JP-A-2001-246769, the driving direction of the pair of conveyance rollers must be switched over (2m−1) times.

Such an operation of switching over the driving direction of the pair of conveyance rollers brings about a time loss. Therefore, if the number of times of switching over the driving direction of the pair of conveyance rollers increases, the total time loss increases accordingly. As a result, the processing performance of the printer lowers. Thus, the techniques disclosed in JP-A-9-99572 and JP-A-2001-246769 can not realize a high processing performance.

Further, in a printer that records color images on a recording paper being conveyed backward, in the case of using the recording paper in a long form, the long recording paper conveyed backward is in a state of a continuous body. This makes it troublesome to deal with the recording paper after image recording.

SUMMARY OF THE INVENTION

An object of the present invention is to provide a printer capable of recording a plurality of frames of color images with a high processing performance with intending to reduce wasteful consumption of a recording medium and prevent the images from being deteriorated due to variation of load in conveyance of the recording medium, and capable of avoiding troublesomeness in dealing with the recording medium after image recording.

A printer according to the present invention comprises a supply unit storing therein a long recording medium; an image recording unit capable of recording a color image, on the recording medium; a cutting unit disposed between the supply unit and the image recording unit and capable of cutting the recording medium; a conveyance mechanism capable of conveying the recording medium in a first direction from the supply unit toward the image recording unit and in a second direction reverse to the first direction, with opposing the recording medium to the image recording unit;

a conveyance controller that controls the conveyance mechanism to convey the recording medium in the first direction until a leading edge of the recording medium reaches a position distant in the first direction from the image recording unit, and then convey the recording medium in the second direction; an image recording controller that controls the image recording unit to record a plurality of frames of color images on the recording medium being conveyed in the second direction by the conveyance mechanism; and a cutting controller that controls the cutting unit to cut the recording medium being conveyed in the second direction by the conveyance mechanism.

In the present invention, "a leading edge of the recording medium reaches a position distant in the first direction from the image recording unit" means that "the recording medium is conveyed in the first direction from the supply unit toward the image recording unit and the leading edge of the recording medium reaches a position downstream of the image recording unit".

According to the present invention, because a plurality of frames of color images are recorded on the recording medium being conveyed in the second direction after the recording medium is conveyed in the first direction, variation of load scarcely occurs while the images are recorded on the recording medium, and color images can be recorded even in the vicinity of the leading edge of the recording medium. That is, deterioration of the images due to the variation of load during the conveyance of the recording medium can be prevented with reducing wasteful consumption of the recording medium. In addition, a plurality of frames of color images can be recorded on the recording medium by one recording operation corresponding to one set of forward and backward movements of the recording medium. Thus, the time loss attendant upon switchover of the conveyance direction can be reduced and a plurality of frames of color images can be recorded with a high processing performance.

In addition, the recording medium can be cut at a desired position by the cutting unit disposed between the image recording unit and the supply unit. While the recording medium is conveyed in the second direction, the image recording unit records a color image on the recording unit and then the cutting unit cuts the recording medium at a desired position. Thereafter, the cut-off recording medium is further conveyed in the second direction to be discharged. Thus, it is not troublesome to deal with the recording medium after image recording. At this time, the position of the recording medium to be cut may be between neighboring color images or may be a position nearer to the supply unit than the color image recorded at the nearest position to the supply unit.

In the printer according to the present invention, the conveyance controller preferably controls the conveyance mechanism to form a slack portion of the recording medium being conveyed in the second direction, between the image recording unit and the cutting unit.

According to the present invention, positional deviation of the recording medium, which may occur when the recording medium is cut, is absorbed by the slack portion and not brought to a region opposite to the image recording unit. Thus, the image can be prevented from being deteriorated due to the positional deviation having occurred attendant upon cutting the recording medium. In addition, because it needs not be interrupted to convey the recording medium and record a color image in the image recording unit, the processing performance is prevented from being lowered.

In the printer according to the present invention, it is preferable that the conveyance mechanism comprises a first pair of conveyance rollers that can pinch the recording medium between the cutting unit and the image recording unit and rotate to give a conveyance force to the recording medium; and a second pair of conveyance rollers that can pinch the recording medium between the cutting unit and the first pair of conveyance rollers and -rotate to give a conveyance force to the recording medium, and the conveyance controller can control the first and second pairs of conveyance rollers independently of each other. Thus, the slack portion can be easily formed.

In the printer according to the present invention, the conveyance controller preferably controls the conveyance mechanism such that a conveyance speed of the recording medium by the second pair of conveyance rollers is higher than a conveyance speed of the recording medium by the first pair of conveyance rollers. Thus, the slack portion can be prevented from being excessively lengthened.

In the printer according to the present invention, it is preferable that the printer further comprises a revolution number detector capable of detecting the number of revolutions of the second pair of conveyance rollers; and a detector capable of detecting a conveyance quantity of the recording medium on the basis of the number of revolutions detected by the revolution number detector, and the cutting controller detects, on the basis of the conveyance quantity detected by the detector, a portion of the recording medium to be cut having reached a cutting position by the cutting unit, and controls the cutting unit to cut the recording medium at the portion to be cut.

In the present invention, "the number of revolutions of a pair of rollers" means "the number of accumulated revolutions of the pair of rollers".

According to the present invention, the efficiency of an operation of cutting the recording medium can be improved. In addition, a position of the recording medium to be cut can be determined with high accuracy.

In the printer according to the present invention, each of the conveyance rollers in the second pair is preferably made of metal. According to this feature, the diameter of each of the conveyance rollers in the second pair scarcely varies because of wear or the like. Thus, the position of the recording medium to be cut can be determined with higher accuracy.

In the printer according to the present invention, it is preferable that the cutting controller sets at least one portion of the recording medium to be cut, between each pair of-neighboring color images, and a portion of the recording medium to be cut, at a position nearer to the supply unit than the color image printed at the nearest position to the supply unit. According to this feature, the recording medium on which a plurality of frames of color images have been recorded can be separated into pieces of the recording medium on each of which only one image has been recorded, to be discharged.

In the printer according to the present invention, it is preferable that the supply unit stores therein the long recording medium in a state of being wound, and comprises a taking-up mechanism capable of taking up the recording medium being conveyed in the second direction by the conveyance mechanism.

According to the present invention, the recording medium once sent out of the supply unit and conveyed in the first direction, can be again taken up in the supply unit. Thus, a slack of the recording medium can be prevented from being formed near the supply unit when the recording medium is conveyed in the second direction. In addition, in the case that the cutting unit cuts the recording medium at a portion nearer to the supply unit than the color image recorded at the nearest position to the supply unit, a portion of the recording medium, on which no image has been recorded, on the supply unit side of the cut portion of the recording medium, can be taken up in the supply unit. Thus, adhesion of dust or the like to the recording medium can be prevented, which may occur if the portion of the recording medium is left outside the supply unit for a long time.

In the printer according to the present invention, the taking-up mechanism preferably comprises a shaft on which the recording medium is wound; and a drive source capable of driving the shaft to rotate so as to take up the recording medium that was unwound from the shaft. According to this feature, when the recording medium is taken up in the supply unit, the recording medium can be smoothly taken up without bending the recording medium.

The printer according to the present invention preferably further comprises a pressing member that can selectively takes a protruding position where the pressing member intersects a segment of a line extending between a contact point of the first pair of conveyance rollers and a contact point of the second pair of conveyance rollers, and a withdrawal position where the degree of protrusion of the pressing member beyond the segment is less than that at the protruding position; a drive mechanism that moves the pressing member between the protruding position and the withdrawal position; and a position controller that controls the drive mechanism to move the pressing member to the protruding position when a length of the slack portion is not more than a predetermined length, and to the withdrawal position when the length of the slack portion is more than the predetermined length.

A state wherein "the degree of protrusion of the pressing member beyond the segment is less than that at the protruding position" may be either of a state wherein a front end of the pressing member is on the same side of the segment as the protrusion position, and a state wherein the front end of the pressing member is on the opposite side of the segment to the protrusion position.

According to the present invention, the slack portion can always be convex in the same direction. This makes it easy to detect the slack portion.

The printer according to the present invention preferably further comprises a detector capable of detecting a point on a convex portion of the slack portion having reached a predetermined position. According to this feature, in the case that the predetermined position is near the segment extending between the contact point of the first pair of conveyance rollers and the contact point of the second pair of conveyance rollers, on the same side of the segment as the front end of the pressing member being at the protruding position, the slack portion can be prevented from being excessively shortened. In the case that the predetermined position is near the front end of the pressing member being at the protruding position, it can be checked that the slack portion has been surely formed. Further, in the case that the predetermined position is farther from the segment extending between the contact point of the first pair of conveyance rollers and the contact point of the second pair of conveyance rollers, than the front end of the pressing member being at the protruding position, the slack portion can be prevented from being excessively lengthened.

The printer according to the present invention preferably further comprises a stopper guide disposed on the same side of the segment extending between the contact point of the first pair of conveyance rollers and the contact point of the second pair of conveyance rollers, as a front end of the pressing member being at the protruding position, so as to be in contact with the slack portion and thereby guide the recording medium when the pressing member is at the protruding position. According to this feature, because the slack portion can be formed into a substantially fixed shape, it is hard to generate an error in the length of the slack portion when the point on the convex portion of the slack portion is detected.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
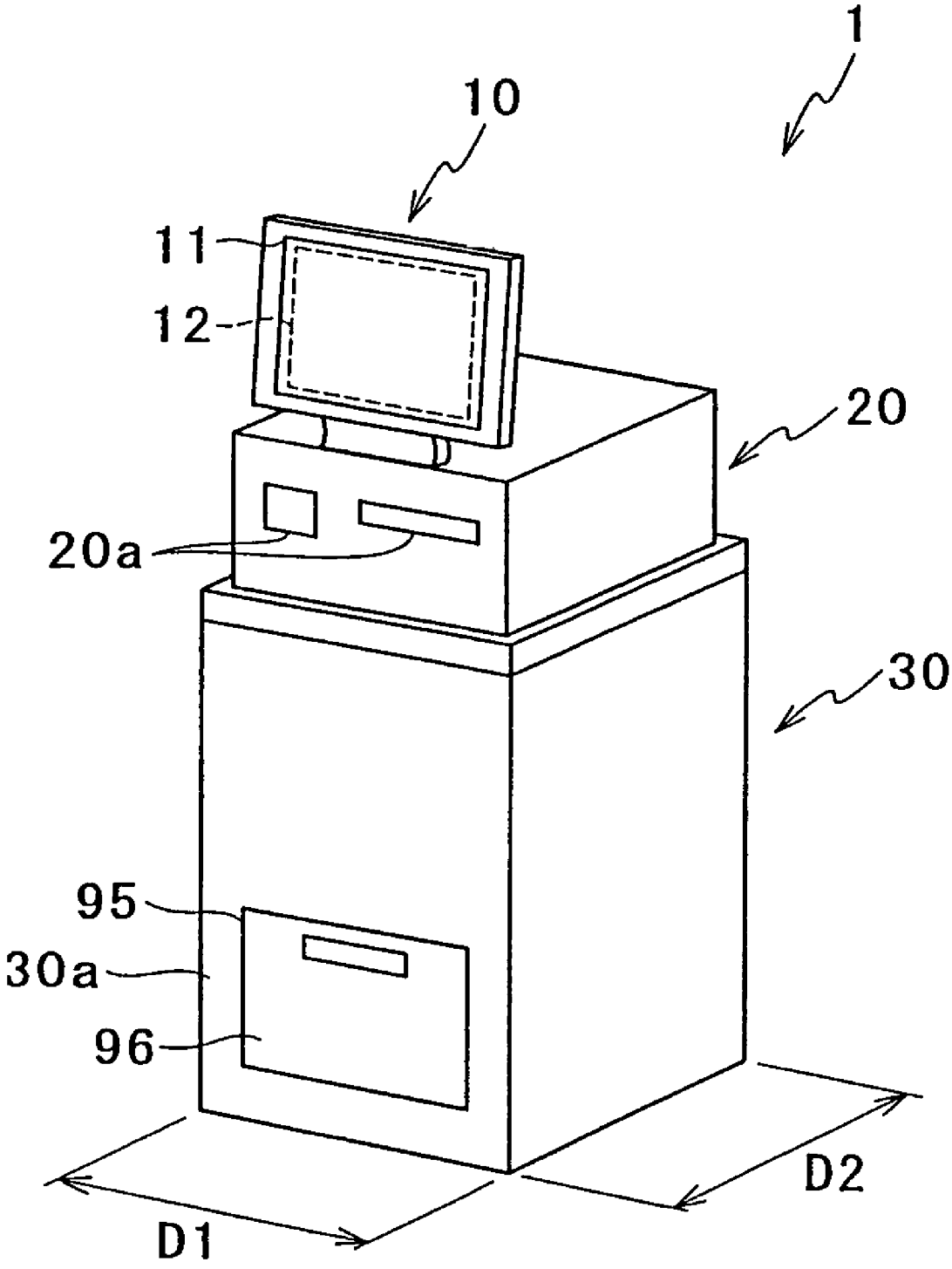
FIG. 1 is an external perspective view of a printer according to an embodiment of the present invention.
Figure 2:
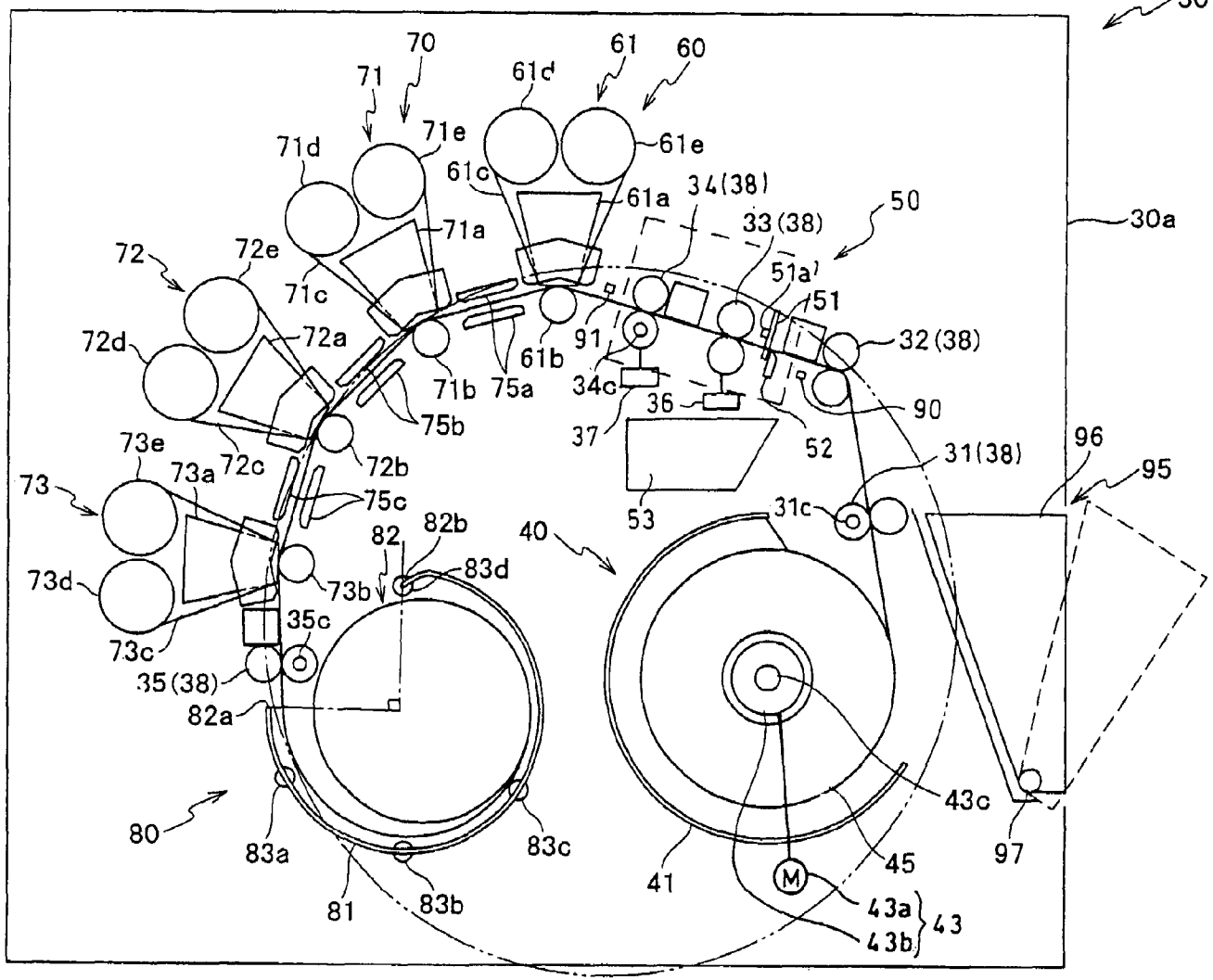
FIG. 2 is a view showing a general construction of a print unit of the printer of FIG. 1.
Figure 3:
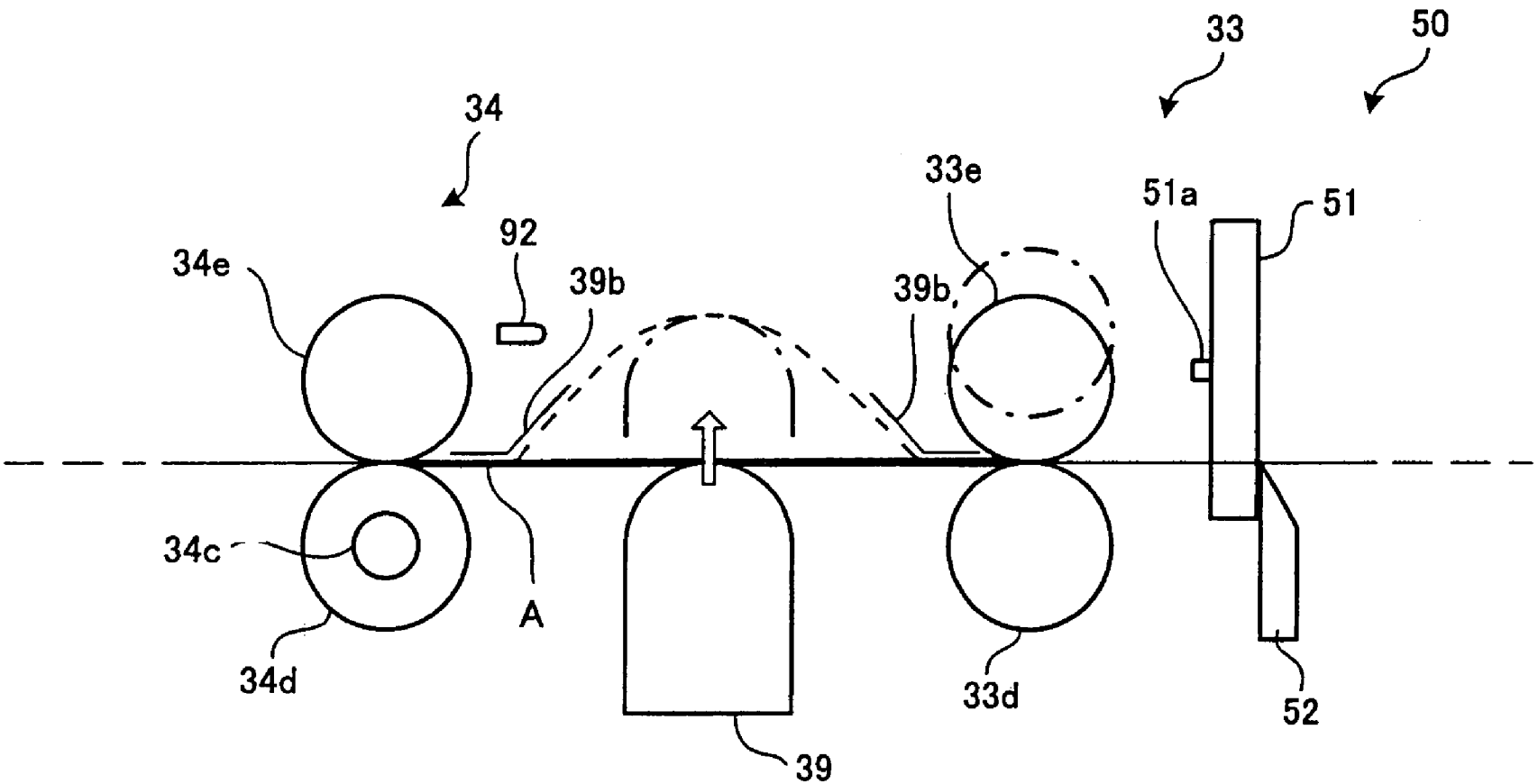
FIG. 3 is an enlarged view of a region in the print unit enclosed with broken lines in FIG. 2.
Figure 4A:
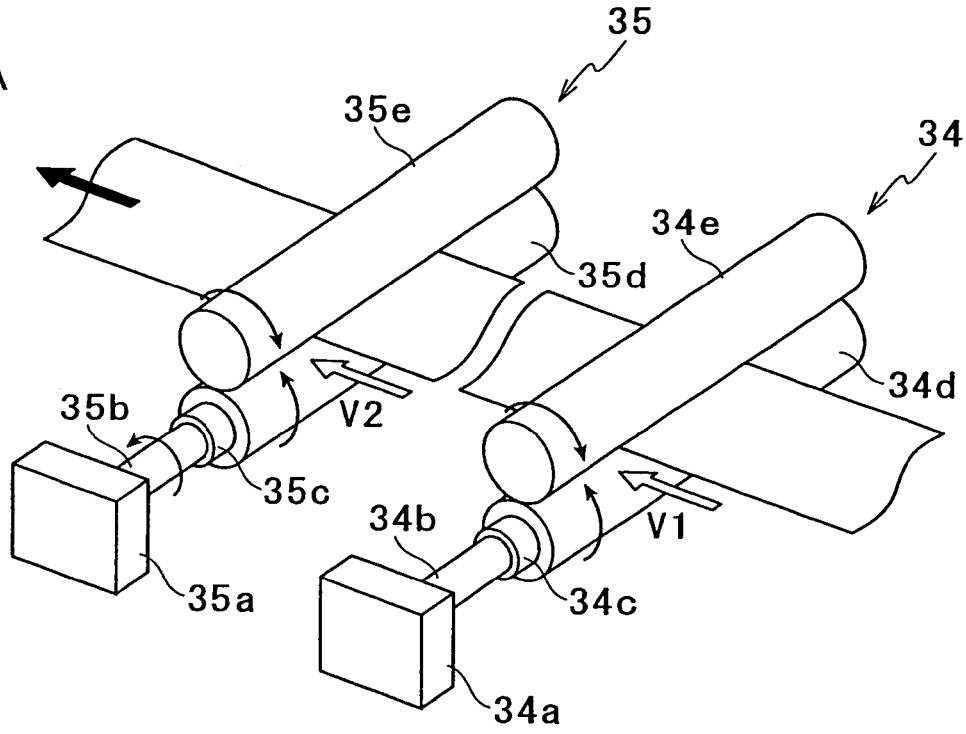
FIGS. 4A and 4B are views showing operations of a pair of conveyance rollers and a pair of sending-in rollers of the printer of FIG. 1.
Figure 4B:
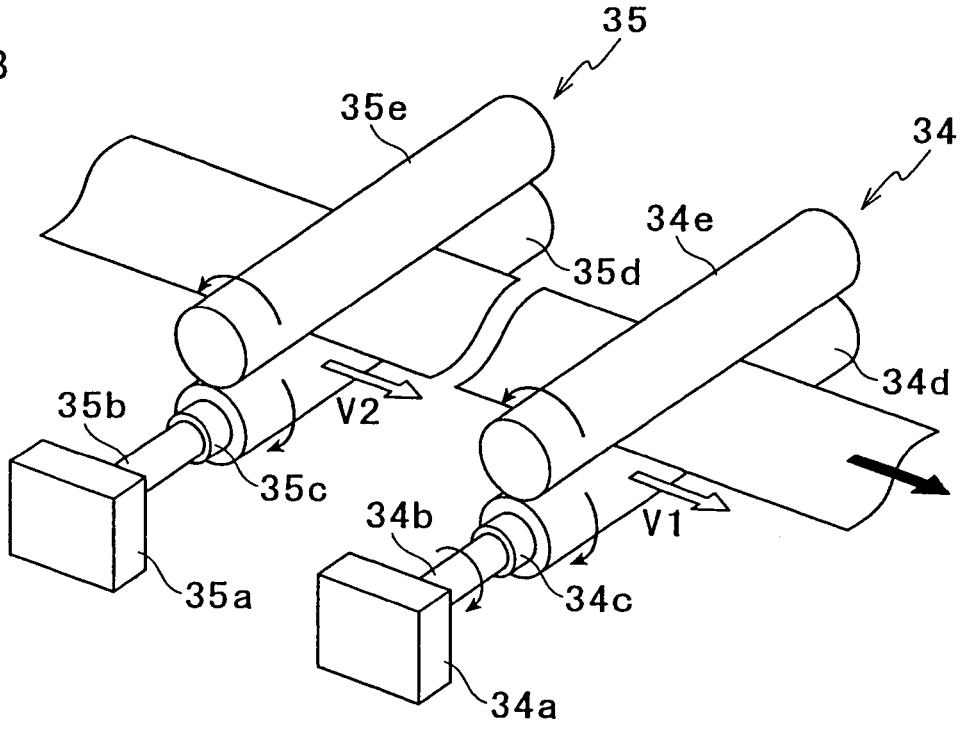
Figure 5:
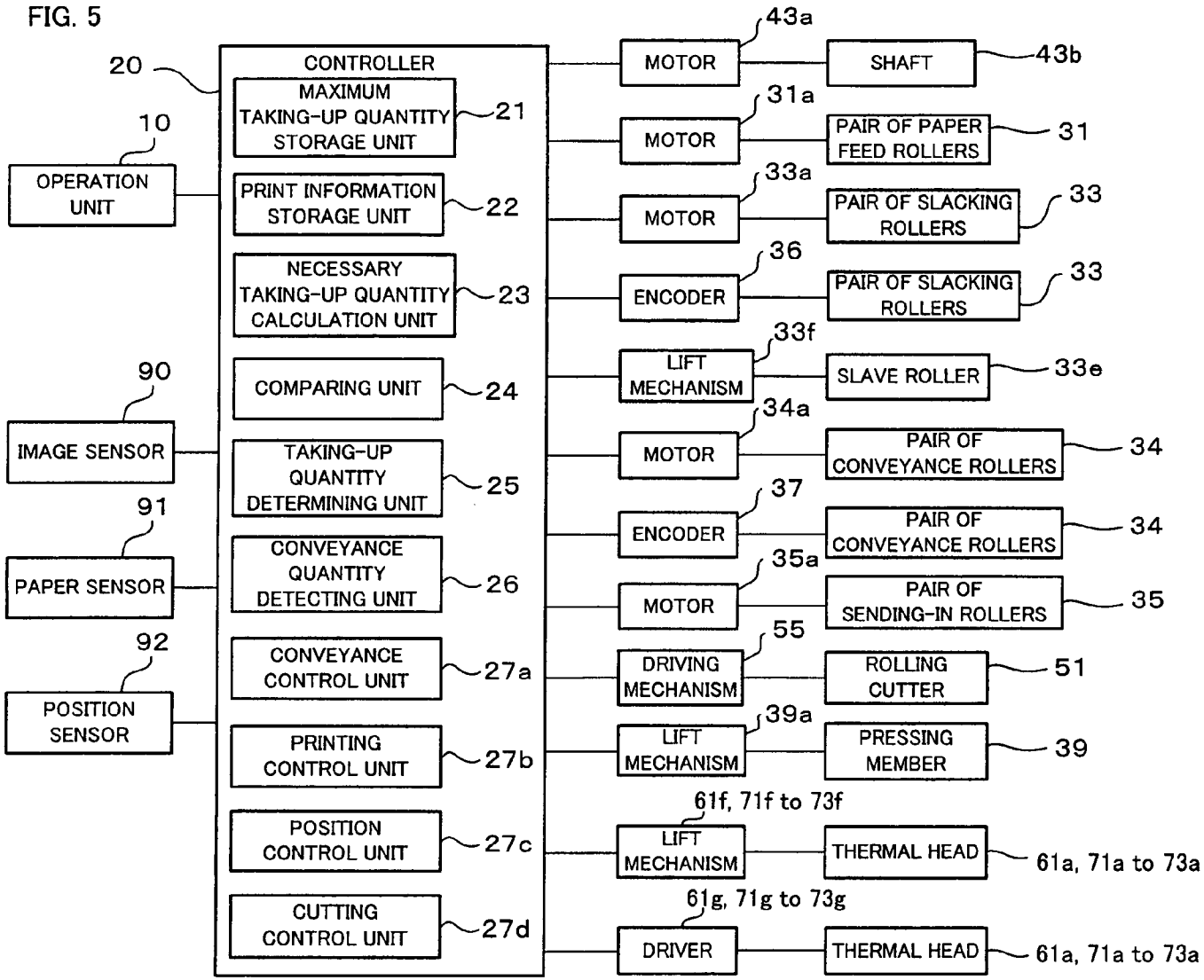
FIG. 5 is a block diagram showing principal components of the printer of FIG. 1 and a controller to which the components are connected.

Hereinafter, a preferred embodiment of the present invention will be described with reference to drawings. FIG. 1 is an external perspective view of a printer according to an embodiment of the present invention. FIG. 2 is a view showing a general construction of a print unit of the printer of FIG. 1. FIG. 3 is an enlarged view of a region in the print unit enclosed with broken lines in FIG. 2. FIGS. 4A and 4B are views showing operations of a pair of conveyance rollers and a pair of sending-in rollers of the printer of FIG. 1. FIG. 5 is a block diagram showing principal components of the printer of FIG. 1 and a controller to which the components are connected.

A dye sublimation printer 1 as shown in FIG. 1 (hereinafter simply referred to as printer 1) includes an operation unit 10, a controller 20, and a print unit 30. The operation unit 10 allows for an operator to operate the printer 1. The operation unit 10 includes a display 11 for displaying thereon various kinds of information in relation to the printer 1 to inform the operator. In this embodiment, a touch panel type of operation unit 10 is adopted and an operation picture 12 containing various buttons is displayed on a screen of the display 10. Therefore, the operator can operate the printer 1 by touching the operation picture 12.

The controller 20 receives inputs through the operation unit 10 and controls various operations of the printer 1. The controller 20 includes a plurality of data input units 20*a* for acquiring print data from various storage media, such as a card slot and a disk drive. Such a storage medium may be of any kind as far as it can store thereon or therein print data. For example, a CD-ROM, a memory card, or the like, can be used for this purpose.

The operation unit 10 and the controller 20 are fixedly disposed on the upper face of a casing 30*a* accommodating therein the print unit 30. The screen of the display 11 of the operation unit 10 and the face of each data input unit 20*a* of the controller 20, from which a storage medium is inserted, are substantially aligned with the front face of the casing 30*a* of the printer 1, i.e., the left face of the casing 30*a* appearing on this side in FIG. 1. This makes it easy for the operator, who is in front of the printer 1, to operate the display 11 and the data input units 20*a*.

The casing 30*a* is substantially made into a rectangular parallelepiped. Its width D1, i.e., the width of the front face, is smaller than its depth D2. Therefore, the printer 1 can be placed even in a space having a relatively narrow width. An opening 95 is formed in the front face of the casing 30*a* for taking a print box 96, as will be described later, out of the casing 30*a*.

As shown in FIG. 2, the print unit 30 includes a paper supply unit 40, a paper taking-up unit 80, and a conveyance mechanism 38 within the casing 30*a*. The paper supply unit 40 holds a rolled paper. The paper taking-up unit 80 takes up the paper unwound from the paper supply unit 40. The conveyance mechanism 38 is capable of conveying the paper along a conveyance path curved in one direction between the paper supply unit 40 and the paper taking-up unit 80. Between the paper supply unit 40 and the paper taking-up unit 80, a cutting unit 50, an overcoating unit 60, and a printing unit 70 are disposed in this order along the conveyance direction of the paper being conveyed along the conveyance path. A print box 96 is provided near the conveyance path between the paper supply unit 40 and the cutting unit 50.

In this embodiment, "the conveyance direction of the paper" or merely "the conveyance direction" means the direction from the paper supply unit 40 toward the paper taking-up unit 80. In this specification, the conveyance direction may be referred to as "forward direction". In contrast with that, the direction from the paper taking-up unit 80 toward the paper supply unit 40 may be referred to as "backward direction". Further, "the front end of the paper" and "the front end of an image" mean the front ends of the paper and image in the conveyance direction, respectively, while "the rear end of the paper" and "the rear end of an image" mean the rear ends of the paper and image in the conveyance direction, respectively.

The paper supply unit 40 includes a magazine case 41 provided at the most upstream portion of the conveyance path, and a taking-up mechanism 43 including a shaft 43*b* and a motor 43*a*. The taking-up mechanism 43 can take up the paper being conveyed upstream in the conveyance direction by the conveyance mechanism 38, into the magazine case 41. In the magazine case 41, a roll 45 is put in which a long paper is rolled on a shaft 43*b* such that the face of the paper to be printed faces outward. The shaft 43*b* is driven by a motor 43*a*, counterclockwise in FIG. 2 when the paper is unwound from the paper supply unit 40 and conveyed downstream in the conveyance direction, and clockwise in FIG. 2 when the paper once unwound is taken up into the paper supply unit 40. The shaft 43*b* is connected to a not-shown shaft to be driven to rotate by the motor 43*a*, through a one-way clutch 43*c* having the same function as one-way clutches 34*c* and 35*c* as will be described later.

The conveyance mechanism 38 can convey the paper unwound from the paper feed unit 40, downstream in the conveyance direction to be taken up in the paper taking-up unit 80, and further can make the paper once taken up in the paper taking-up unit 80, be unwound again, and convey the paper unwound from the paper taking-up unit 80 backward, i.e., upstream in the conveyance direction.

The conveyance mechanism 38 includes a pair of paper feed rollers 31 disposed near the paper supply unit 40; a pair of turn rollers 32 disposed between the pair of paper feed rollers 31 and the cutting unit 50; a pair of slacking rollers 33 and a pair of conveyance rollers 34 disposed between the cutting unit 50 and the overcoating unit 60; and a pair of sending-in rollers 35 disposed downstream in the conveyance direction of the printing unit 70. The pair of paper feed rollers 31 can take the paper out of the paper supply unit 40 and send back the paper into the paper supply unit 40. The pair of turn rollers 32 turn the conveyance direction of the paper being conveyed upward. The pair of slacking rollers 33 and the pair of conveyance rollers 34 can convey the paper with pinching the paper. The pair of sending-in rollers 35 send the paper being conveyed downstream in the conveyance direction of the printing unit 70, into the paper taking-up unit 80. In this embodiment, each of the paper feed rollers 31, the turn rollers 32, and the sending-in rollers 35 is made of a resin. Each of the slacking rollers 33 and the conveyance rollers 34 is made of metal.

The pair of paper feed rollers 31, the pair of turn rollers 32, the pair of slacking rollers 33, the pair of conveyance rollers 34, and the pair of sending-in rollers 35 are arranged along a circumference of a predetermined radius as shown by an alternate long and two short dashes line in FIG. 2. As apparent from FIG. 2, an overcoating head 61 of the overcoating unit 60 and print heads 71 to 73 of the printing unit 70 are also arranged along the circumference, and the paper supply unit 40 and the paper taking-up unit 80 are disposed inside the circumference.

The pair of paper feed rollers 31, the pair of slacking rollers 33, the pair of conveyance rollers 34, and the pair of sending-in rollers 35 are connected to motors 31*a*, 33*a*, 34*a*, and 35*a* as shown in FIG. 5, respectively. The motors 31*a*, 33*a*, 34*a*, and 35*a* are controlled by a conveyance control unit 27*a* as shown in FIG. 5 to drive the respected pair of rollers to rotate.

Operations of the pair of conveyance rollers 34 and the pair of sending-in rollers 35 will be described with reference to FIGS. 4A and 4B. FIG. 4A shows operations of the pair of conveyance rollers 34 and the pair of sending-in rollers 35 when the paper is conveyed downstream in the conveyance direction. FIG. 4B shows operations of the pair of conveyance rollers 34 and the pair of sending-in rollers 35 when the paper is conveyed backward, i.e., upstream in the conveyance direction. As shown in FIGS. 4A and 4B, the pair of conveyance rollers 34 comprise a drive roller 34*d* and a slave roller 34*e*. The drive roller 34*d* is connected through a one-way clutch 34*c* to a shaft 34*b* to be driven to rotate by a motor 34*a*. Likewise, the pair of sending-in rollers 35 comprise a drive roller 35*d* and a slave roller 35*e*. The drive roller 35*d* is connected through a one-way clutch 35*c* to a shaft 35*b* to be driven to rotate by a motor 35*a*.

The one-way clutches 34*c* and 35*c* are the same in function. Thus, only a function of the one-way clutch 34*c* will be described here. The one-way clutch 34*c* is fixed to the drive roller 34*d* so that they can rotate as one body. In the case that the drive roller 34*d* rotates faster than the rotational speed of the shaft 34*b*, the rotational power of the shaft 34*b* is not transmitted to the drive roller 34*d* and the drive roller 34*d* slips on the shaft 34*b*. In the other cases, the rotational power of the shaft 34*b* is transmitted to the drive roller 34*d* through the one-way clutch 34*c* and the shaft 34*b* and the drive roller 34*d* rotate as one body.

Thus, when the actual conveyance speed of the paper being pinched by the pair of conveyance rollers 34 is lower than the conveyance speed of the paper based on the rotational power of the pair of conveyance rollers 34 driven by the motor 34*a*, the drive force of the motor 34*a* is transmitted to the pair of conveyance rollers 34. In this case, the paper is conveyed by the conveyance force given by the pair of conveyance rollers 34. On the other hand, when the actual conveyance speed of the paper is higher than the conveyance speed of the paper based on the rotational power of the pair of conveyance rollers 34 driven by the motor 34*a*, the drive force of the motor 34*a* is not transmitted to the pair of conveyance rollers 34 and the pair of conveyance rollers 34 can be freely rotated. That is, the pair of conveyance rollers 34 are rotated at a rotational speed corresponding to the actual conveyance speed of the paper.

Supposing that the conveyance speed of the paper based on the rotational power of the pair of conveyance rollers 34 driven by the motor 34*a* is V1 and the conveyance speed of the paper based on the rotational power of the pair of sending-in rollers 35 driven by the motor 35*a* is V2, a case wherein the paper is conveyed downstream in the conveyance direction will be considered with reference to FIG. 4A. In this case, as will be described later, after the leading edge of the paper reaches the pair of sending-in rollers 35 and the paper is pinched by the pair of sending-in rollers 35, the pair of conveyance rollers 34 are stopped to be driven and thus the conveyance speed V1 becomes zero. On the other hand, as for the pair of sending-in rollers 35, the drive force of the motor 35*a* is transmitted to the pair of sending-in rollers 35 through the shaft 35*b* and the one-way clutch 35*c* and thereby the pair of sending-in rollers 35 are driven to rotate. Thus, the paper being pinched by the pair of conveyance rollers 34 is conveyed at the conveyance speed V2. As a result, the pair of conveyance rollers 34 become freely rotatable by the function of the one-way clutch 34*c*.

Next, a case wherein the paper is conveyed backward, i.e., upstream in the conveyance direction, will be considered with reference to FIG. 4B. In this case, as will be described later, because the pair of sending-in rollers 35 are stopped to be driven, the conveyance speed V2 becomes zero. On the other hand, as for the pair of conveyance rollers 34, the drive force of the motor 34*a* is transmitted to the pair of conveyance rollers 34 through the shaft 34*b* and the one-way clutch 34*c* and thereby the pair of conveyance rollers 34 are driven to rotate. Thus, the paper being pinched by the pair of sending-in rollers 35 is conveyed backward at the conveyance speed V1. As a result, the pair of sending-in rollers 35 become freely rotatable by the function of the one-way clutch 35*c*.

The pair of paper feed rollers 31 are also connected to a dot-shown shaft to be driven to rotate by the motor 31*a*, through a one-way clutch 31*c* having the same function as the above-described one-way clutches 34*c* and 35*c*.

Next, the construction of the pair of slacking rollers 33 will be described. The pair of slacking rollers 33 comprise a drive roller 33*d* and a slave roller 33*e*, as shown in FIG. 3. The drive roller 33*d* is connected to a not-shown shaft to be driven to rotate by the motor 33*a*, through no one-way clutch. The slave roller 33*e* can be moved by a lift mechanism 33*f* as shown in FIG. 5, to get near to and apart from the conveyance path of the paper. Thus, the slave roller 33*e* can selectively take a pressing position where it cooperates with the drive roller 33*d* to pinch the paper, as shown by a solid line in FIG. 3, and a withdrawal position where it is distant from the paper, as shown by an alternate long and short dash line in FIG. 3.

The print unit 30 further includes therein an encoder 36 capable of detecting the number of revolutions of the pair of slacking rollers 33, and an encoder 37 capable of detecting the number of revolutions of the pair of conveyance rollers 34. As described above, the pair of conveyance rollers 34 can take a state of being driven by the motor 34*a* to rotate to convey the paper, and a state of being rotated by following the paper being conveyed by the pair of sending-in rollers 35. When the pair of conveyance rollers 34 are in either state, the encoder 37 can detect the number of revolutions of the pair of conveyance rollers 34.

As shown in FIG. 3, a pressing member 39 is disposed between the pair of slacking rollers 33 and the pair of conveyance rollers 34. The pressing member 39 can be moved by a lift mechanism 39*a* as shown in FIG. 5, which is controlled by a position control unit 27*c* as shown in FIG. 5, perpendicularly to a segment A of a line extending between the contact point of the pair of slacking rollers 33 and the contact point of the pair of conveyance rollers 34, as shown in FIG. 3. More specifically, the pressing member 39 can selectively take a protruding position where its upper face pushes the paper upward across the segment A, as shown by an alternate long and short dash line in FIG. 3, and a withdrawal position where its upper face is near the segment A not across the segment A, as shown by solid lines in FIG. 3. Guides 39*b* are provided near the segment A on the same side of the segment A as the upper face of the pressing member 39 being at the protruding position. The guides 39*b* are disposed near the pair of slacking rollers 33 and the pair of conveyance rollers 34, respectively, so as to be in contact with the paper when the pressing member 39 is at the protruding position.

The cutting unit 50 is disposed between the pair of turn rollers 32 and the pair of slacking rollers 33. The cutting unit 50 includes therein a rolling cutter 51 disposed above the conveyance path, a fixed cutting edge 52 disposed below the conveyance path, and a dust box 53.

The rolling cutter 51 is disk-shaped. A cutting edge is formed on the whole circumference of the rolling cutter 51. The center of the rolling cutter 51 is supported by a shaft 51*a*. The rolling cutter 51 is connected through the shaft 51*a* to a driving mechanism 55, as shown in FIG. 5, under the control of a cutting control unit 27*d*. The driving mechanism 55 drives, through the shaft 51*a*, the rolling cutter 51 to rotate and reciprocate perpendicularly to the conveyance path of the paper, i.e., perpendicularly to FIG. 2. The fixed cutting edge 52 is disposed perpendicularly to the conveyance path of the paper. The fixed cutting edge 52 is a rectangular cutting edge longer than the whole width of the conveyance path of the paper.

Thus, in a state wherein the paper is at the cutting position by the cutting unit 50, the cutting control unit 27*d* controls the driving mechanism 55 to rotate the rolling cutter 51 and move it along the width of the paper so that the rolling cutter 51 cooperates with the fixed cutting edge 52 to cut the paper. In the printer 1 of this embodiment, the cutting unit 50 cuts the paper at the front and rear ends of each image, as will be described later.

The dust box 53 is disposed below the rolling cutter 51 and the fixed cutting edge 52. Therefore, when the paper is cut at the front and rear ends of each image and thereby margins between the images are cut off, the margins are collected in the dust box 53.

The overcoating unit 60 is disposed at a position distant from the pair of conveyance rollers 34 in the conveyance direction. The overcoating unit 60 has an overcoating head 61. The overcoating head 61 is for applying a colorless, transparent overcoating (OC) on the surface of the paper on which an image has been printed. By thus applying the overcoating on the surface of the paper, the light resistance of the image printed on the paper is improved and the surface of the paper can be protected. If the material of the overcoating is adequately selected, the glossiness of print is improved and a high-quality print can be provided.

The printing unit 70 is disposed between the overcoating unit 60 and the pair of sending-in rollers 35. The printing unit 70 has three print heads 71 to 73. The print heads 71 to 73 are for printing colors of cyan (C), magenta (M), and yellow (Y), respectively. In the printer 1, the print head 71 corresponding to cyan, the print head 72 corresponding to magenta, and the print head 73 corresponding to yellow are arranged in this order along the conveyance direction. In the printer 1, the pair of conveyance rollers 34 are disposed at the positions distant from the overcoating and printing units 60 and 70 in the backward direction, while the pair of sending-in rollers 35 are disposed at the positions distant from the overcoating and printing units 60 and 70 in the conveyance direction.

In the printer 1 of this embodiment, when the paper unwound from the paper feed unit 40 is conveyed downstream in the conveyance direction, overcoating by the overcoating unit 60 and printing any color image by the printing unit 70 are not performed. When the paper once taken up in the paper taking-up unit 80 disposed at a position distant from the printing unit 70 in the conveyance direction is conveyed backward, i.e., upstream in the conveyance direction, printing an image by the printing unit 70 and overcoating by the overcoating unit 60 are performed. Thus, in the printer 1, a color image can be printed on the surface of the paper in the order of yellow, magenta, and cyan, and an overcoating can be applied to the surface of the paper on which the color image has been printed.

In the printing unit 70, a plurality of frames of images are printed on the paper along the conveyance direction. In this embodiment, the plurality of frames of images are referred to as a first image, a second image, a third image, . . . , from the image printed at the most upstream position in the conveyance direction.

Next, general constructions of the overcoating head 61 and the print heads 71 to 73 will be described. Because the overcoating head 61 and the print heads 71 to 73 have the same construction, only the print head 73 will be described here in detail.

The print head 73 includes a thermal head 73*a* having thereon a large number of not-shown heating elements arranged in a row over the whole width of the conveyance path of the paper; a platen roller 73*b* opposed to the front end of the thermal head 73*a*, i.e., the end of the thermal head 73*a*, near the conveyance path of the paper, on which the heating elements are arranged; a tape-like ribbon 73*c* having thereon an ink region to which ink corresponding to yellow has adhered; a ribbon supply roller 73*d* on which the unused portion of the ribbon 73*c* has been wound; and a ribbon taking-up roller 73*e* on which the used portion of the ribbon 73*c* is taken up.

The thermal head 73*a* can be moved by a lift mechanism 73*f*, as shown in FIG. 5, so as to get near to or far from the conveyance path of the paper. Thus, the thermal head 73*a* can be selectively put at an operative position at which the ribbon 73*c* is pressed onto the paper between the vicinity of the front end of the thermal head 73*a* and the platen roller 73*b*; and at a withdrawal position at which the ribbon 73*c* is not pressed onto the paper.

In the case of the print head 73, when the paper is conveyed between the thermal head 73*a* and the platen roller 73*b* in a state wherein the thermal head 73*a* is put at the operative position, ink adhering to the ribbon 73*c* is heated by the thermal head 73*a* and then transferred onto the paper. Thereby, a color image corresponding to yellow can be printed on the paper. At this time, attendant upon the conveyance of the paper, the ribbon 73*c* is also sent from the ribbon supply roller 73*d* toward the ribbon taking-up roller 73*e*.

Like the print head 73, the overcoating head 61 and the print heads 71 and 72 include thermal heads 61*a*, 71*a*, and 72*a*; platen rollers 61*b*, 71*b*, and 72*b*; ribbons 61*c*, 71*c*, and 72*c*; ribbon supply rollers 61*d*, 71*d*, and 72*d*; ribbon taking-up rollers 61*e*, 71*e*, and 72*e*; and lift mechanisms 61*f*, 71*f*, and 72*f*, respectively.

In the overcoating head 61 and the print heads 71 and 72, in place of the tape-like ribbon 73*c* of the print head 73, having thereon the ink region to which ink corresponding to yellow has adhered, the ribbons 61*c*, 71*c*, and 72*c* are used that have thereon ink regions to which colorless, transparent ink, ink corresponding to cyan, and ink corresponding to magenta, have adhered, respectively.

Pairs of guides 75*a* to 75*c* are disposed in the respective intervals between the overcoating head 61 of the overcoating unit 60 and the print heads 71 to 73 of the printing unit 70. Each of the pairs of guides 75*a* to 75*c* are constituted by two guide boards for guiding the paper, mainly the front end of the paper, being conveyed in the respective intervals between the overcoating head 61 and the print heads 71 to 73. That is, each pair of guides 75*a* to 75*c* are disposed on both sides of the conveyance path of the paper so as to be opposed to each other at a predetermined distance.

The paper taking-up unit 80 includes a housing case 81 at the most downstream position of the conveyance path. The housing case 81 is substantially cylindrical. Part of the housing case 81 is opened to form an insertion opening 82 for the paper. In this embodiment, as shown in FIG. 2, the central angle corresponding to the insertion opening 82 is about 90 degrees. One edge 82*a* of the insertion opening 82 is near the left end of the housing case 81 while the other edge 82*b* is near the upper end of the housing case 81.

The pair of sending-in rollers 35 are disposed near the upper portion of the edge 82*a* of the housing case 81. The paper conveyed downward by the pair of sending-in rollers 35 passes near the edge 82*a* of the insertion opening 82 to be inserted in the housing case 81. The paper inserted in the paper taking-up unit 80 comes into contact with the inner circumferential surface of the housing case 81 to be guided. As a result, in the housing case 81, the paper is taken up in order from its leading edge in accordance with its curling tendency such that the face of the paper to be printed faces outward. Four taking-up rollers 83*a* to 83*d* are provided in the housing case 81 so as to be freely rotatable. Part of each of the taking-up rollers 83*a* to 83*d* protrudes inward beyond the inner circumferential surface of the housing case 81. Thus, the friction force upon the paper coming into contact with the inner circumferential surface of the housing case 81 is relieved and this prevents the paper from being scratched.

The print box 96 is for receiving print papers on which color images have been printed by the printing unit 70 and an overcoating have been applied by the overcoating unit 60 and which have been cut off by the cutting unit 50. The print box 96 is a box whose upper face is opened. The print box 96 is supported at its lower end by a support shaft 97 so as to be swingable. Thereby, the print box 96 can take a state wherein the print box 96 is received within the casing 30*a*, as shown by solid lines in FIG. 2, and a state wherein the vicinity of the upper end of the print box 96 is pulled out from the front face of the casing 30*a*, i.e., the right face of the casing 30*a* in FIG. 2, as shown by broken lines in FIG. 2. Thus, the operator can pull out the upper end portion of the print box 96 from the front face of the casing 30*a* of the printer 1 so that the operator can easily take out papers on which color images have been printed.

A not-shown switchover mechanism is provided in the upper portion of the print box 96. The switchover mechanism is adjacent to a position in the conveyance path more upstream than the pair of turn rollers 32 in the conveyance direction. The switchover mechanism is for switching over the conveyance path of the paper being conveyed backward, i.e., upstream in the conveyance direction, between a case wherein the paper is to be taken up by the paper supply unit 40 and a case wherein a piece of the paper on which a color image has been printed is discharged into the print box 96. Thus, by controlling the switchover mechanism, only pieces of the paper on which color images have been printed can be collected in the print box 96.

An image sensor 90 is adjacent to a position in the conveyance path more upstream than the cutting unit 50 in the conveyance direction. The image sensor 90 can detect an end of an image, mainly the rear end of the image, printed on the paper being conveyed on the conveyance path. A paper sensor 91 is provided at a position distant from the overcoating unit 60 in the backward direction. The paper sensor 91 can detect an end of the paper. In this embodiment, the upstream end in the conveyance direction of the overcoating unit 60 substantially coincides with the detection position of the paper sensor 91. In addition, a position sensor 92 is provided near the upper face of the pressing member 39 being at the protruding position, for detecting the upper face of the pressing member 39 having reached the protruding position.

As shown in FIGS. 4A and 4B, to the controller 20 connected are the motor 43*a* for driving the shaft 43*b* of the paper supply unit 40; the motors 31*a*, 33*a*, 34*a*, and 35*a* for driving the pair of paper feed rollers 31, the pair of slacking rollers 33, the pair of conveyance rollers 34, and the pair of sending-in rollers 35, respectively; the lift mechanism 33*f* for the slave roller 33*e* of the pair of slacking rollers 33; the encoder 36 for detecting the number of revolutions of the pair of slacking rollers 33; the encoder 37 for detecting the number of revolutions of the pair of conveyance rollers 34; the lift mechanism 39*a* for the pressing member 39; the driving mechanism 55 for the rolling cutter 51 of the cutting unit 50; the lift mechanisms 61*f* and 71*f* to 73*f* and drivers 61*g* and 71*g* to 73*g* for the thermal heads 61*a* and 71*a* to 73*a* of the overcoating and printing units 60 and 70; the image sensor 90; the paper sensor 91; the position sensor 92; and the operation unit 10.

The controller 20 is made up of hardware components, such as a CPU, a ROM, and a RAM, controlled by an adequate software program. The controller 20 includes therein a maximum taking-up quantity storage unit 21, a print information storage unit 22, a necessary taking-up quantity calculation unit 23, a comparing unit 24, a taking-up quantity determining unit 25, a conveyance quantity detecting unit 26, a conveyance control unit 27*a*, a printing control unit 27*b*, a position control unit 27*c*, and a cutting control unit 27*d*.

The maximum taking-up quantity storage unit 21 stores therein, as the maximum taking-up quantity, the maximum length of the paper being conveyed forward, that can be conveyed downstream in the conveyance direction of the printing unit 70, when the paper is conveyed from the paper supply unit 40 to the paper taking-up unit 80. The maximum taking-up quantity can be calculated by summing up the length of the conveyance path between the printing position of the print head 73 disposed at the most downstream position in the conveyance direction in the printing unit 70 and the insertion opening 82 of the paper taking-up unit 80, and the length of the paper that can be taken up in the housing case 81 of the paper taking-up unit 80. The maximum taking-up quantity is input to the maximum taking-up quantity storage unit 21 by the operator.

The maximum taking-up quantity varies mainly in accordance with the size of the housing case 81. The length of the paper that can be taken up in the housing case 81 may be equal to the maximum length of the paper that can be actually received in the housing case 81, or shorter than the maximum length of the paper that can be received in the housing case 81. In any case, the operator can set the maximum taking-up quantity to an arbitrary value. Thus, in this embodiment, as the length of the paper that can be taken up in the housing case 81, for use in calculation of the maximum taking-up quantity, a length has been set that is in a range that the paper is not damaged and scratched in the housing case 81, and shorter than the maximum length of the paper that can be received in the housing case 81.

The print information storage unit 22 stores therein various set values upon printing color images. The set values include a print length, in the conveyance direction, of one frame for each print kind; the number of prints, i.e., the number of frames; a length of a margin to be formed between neighboring images; and an additional length for heat radiation of the head. As the print length of one frame for each print kind, a plurality of values are stored to correspond to a plurality of print kinds, such as a standard size and a panorama size. As the number of prints, a value input by the operator for each order before printing is stored. As each of the length of the margin between images and the additional length for heat radiation of the head, a value input by the operator before printing is stored. The additional length is set to a length such that the paper is opposed to each of the thermal heads 61*a* and 71*a* to 73*a* until the temperature of the thermal heads 71*a* to 73*a* heated for printing images and the thermal head 61*a* heated for overcoating becomes substantially equal to the temperature of the surroundings after electrification is stopped. In this embodiment, the additional length is calculated by the product of the time necessary for the temperature of any of the heated thermal heads 61*a* and 71*a* to 73*a* to become substantially equal to the temperature of the surroundings, and the conveyance speed of the paper being conveyed backward, i.e., upstream in the conveyance direction.

In this embodiment, "one order" means one set of frames of color images to be dealt with by the printer 1. For example, in the case that the printer 1 deals with, as one set, a plurality of frames of color images corresponding to an order from one client, the plurality of frames of color images corresponding to the order from the client are considered to be the plurality of frames of color images contained in one order. On the other hand, in the case that the printer 1 deals with, as one set, a plurality of frames of color images corresponding to orders from a plurality of clients, the plurality of frames of color images corresponding to the orders from the plurality of clients are considered to be the plurality of frames of color images contained in one order. Further, other than the above case wherein the order or orders from one or more clients are considered to be one order, in the case that an operator gives the printer 1 a print instruction for recording a plurality of frames of color images irrespective of which client each frame is in connection with, the plurality of frames of color images in accordance with the print instruction are considered to be the plurality of frames of color images contained in one order.

The necessary taking-up quantity calculation unit 23 calculates, as a necessary taking-up quantity, the minimum length of the paper necessary for printing all of a plurality of frames of color images contained in one order. That is, for printing all of a plurality of frames of color images contained in one order, a length of the paper on which the color images can be printed must have been conveyed downstream in the conveyance direction of the printing unit 70 before the printing unit 70 starts printing the color images. Thus, a length of the paper being conveyed from the paper supply unit 40 toward the paper taking-up unit 80, to be conveyed beyond the printing position of the print head 73 of the printing unit 70 for printing all of a plurality of frames of color images contained in one order, is calculated as the necessary taking-up quantity.

Figure 6:
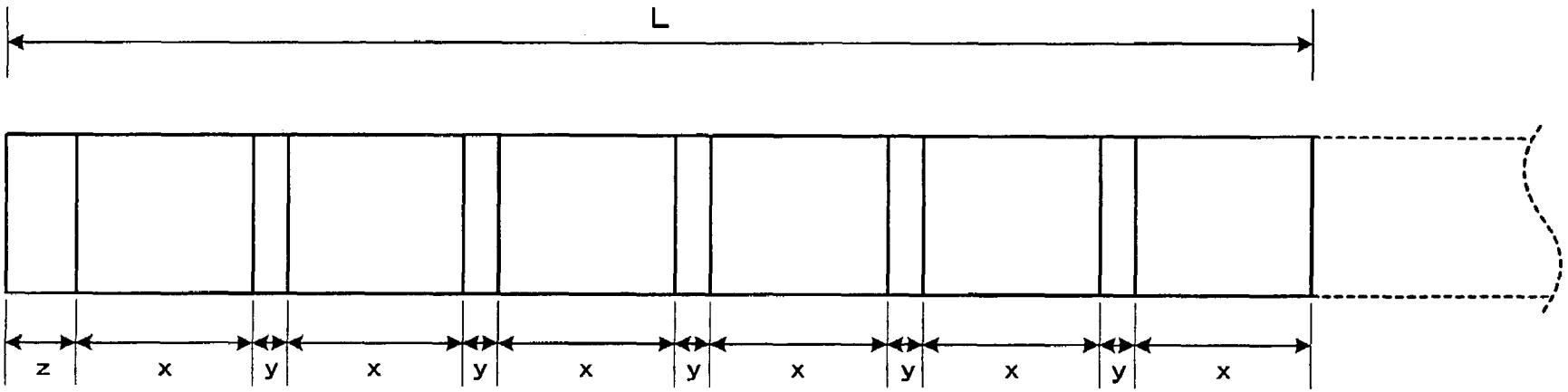
FIG. 6 is a view showing a state wherein a plurality of frames of color images contained in one order are printed near the leading edge of a paper.

Here, the necessary taking-up quantity will be described with reference to FIG. 6. FIG. 6 is a view showing a state wherein a plurality of frames of color images contained in one order are printed near the leading edge of the paper. FIG. 6 shows a case wherein six images of the same print kind are contained in one order. As shown in FIG. 6, a region corresponding to the additional length z for heat radiation of the head is provided near the leading edge of the paper, i.e., the left end in FIG. 6. From the region toward the backward direction, i.e., rightward in FIG. 6, a region corresponding to the print length x and a region corresponding to the margin length y are alternately provided the times corresponding to the number n of prints.

Thus, when the operator inputs the print kind and the number of prints of color images contained in one order before starting to print, the necessary taking-up quantity calculation unit 23 calculates, on the basis of the values stored in the print information storage unit 22, the necessary taking-up quantity L corresponding to one order by the following equation:

$$L=z+x\times n+y\times(n-1).$$

The comparing unit 24 compares the necessary taking-up quantity calculated by the necessary taking-up quantity calculation unit 23 with the maximum taking-up quantity stored in the maximum taking-up quantity storage unit 21. The comparing unit 24 obtains a comparison result as to whether the necessary taking-up quantity is larger or smaller than the maximum taking-up quantity.

The taking-up quantity determining unit 25 determines a length of the paper to be actually conveyed downstream in the conveyance direction of the printing unit 70, i.e., the actual taking-up quantity, before the conveyance direction of the paper is switched over from the forward direction to the backward direction, that is, a length of the paper to be conveyed forward after the leading edge of the paper being conveyed forward passes the print head 73 of the printing unit 70. The taking-up quantity determining unit 25 determines the taking-up quantity on the basis of the comparison result in the comparing unit 24. That is, when the comparing unit 24 obtains a comparison result indicating that the necessary taking-up quantity is not more than the maximum taking-up quantity, the taking-up quantity determining unit 25 adopts the necessary taking-up quantity as the actual taking-up quantity. Contrastingly, when the comparing unit 24 obtains a comparison result indicating that the necessary taking-up quantity is more than the maximum taking-up quantity, the taking-up quantity determining unit 25 adopts the maximum taking-up quantity as the actual taking-up quantity.

The conveyance quantity detecting unit 26 detects a conveyance quantity of the paper on the basis of the numbers of revolutions of the pair of slacking rollers 33 and the pair of conveyance rollers 34 detected by the encoders 36 and 37. For example, the conveyance quantity detecting unit 26 detects the length of the paper having been conveyed downstream in the conveyance direction of the detection position of the paper sensor 91, on the basis of the number of revolutions of the pair of conveyance rollers 34 detected by the encoder 37 after the leading edge of the paper is detected by the paper sensor 91. As a result, the conveyance quantity detecting unit 26 can detect the length of the paper between the leading edge of the paper and the print head 73 of the printing unit 70 before the conveyance direction of the paper is switched over from the forward direction to the backward direction. As will be described later, when the paper is conveyed downstream in the conveyance direction, after the leading edge of the paper reaches the pair of sending-in rollers 35, the paper is conveyed by not the conveyance force given by the pair of conveyance rollers 34 but the conveyance force given by the pair of sending-in rollers 35. Even in this case, the conveyance quantity detecting unit 26 detects the conveyance quantity of the paper always on the basis of the number of revolutions of the pair of conveyance rollers 34.

The conveyance quantity detecting unit 26 can detect the conveyance quantity of the paper not only when the paper is conveyed downstream in the conveyance direction but also when the paper is conveyed upstream in the conveyance direction. Therefore, after the conveyance direction of the paper is switched over from the forward direction to the backward direction, the position of the leading edge of the paper can be detected by subtracting the conveyance quantity upstream in the conveyance direction after the switchover of the conveyance direction, from the conveyance quantity downstream in the conveyance direction before the switchover of the conveyance direction.

The conveyance control unit 27*a* controls the motors 43*a*, 31*a*, 33*a*, 34*a*, and 35*a* for driving the shaft 43*b*, the pair of paper feed rollers 31, the pair of slacking rollers 33, the pair of conveyance rollers 34, and the pair of sending-in rollers 35, and the lift mechanism 33*f* for the slave roller 33*e* of the pair of slacking rollers 33, to convey the paper forward and to convey the paper backward with forming a slack between the cutting unit 50 and the overcoating unit 60.

The function of the conveyance control unit 27*a* will be described in more detail. First, when the paper is taken out of the paper supply unit 40 and conveyed downstream in the conveyance direction, the lift mechanism 33*f* is controlled to put the slave roller 33*e* of the pair of slacking rollers 33 at the withdrawal position and the drive of the motor 33*a* is stopped. That is, the pair of slacking rollers 33 gives no conveyance force to the paper. The drive of the motor 34*a* is stopped until the leading edge of the paper passes the pair of conveyance rollers 34 and reaches the detection position of the paper sensor 91. In addition, the motors 43*a* and 31*a* are controlled such that the conveyance speed of the paper based on the rotational power of the pair of paper feed rollers 31 is higher than the speed of sending out the paper based on the rotational power of the shaft 43*b*. At this time, the shaft 43*b* and the pair of conveyance rollers 34 are freely rotatable by the functions of the one-way clutches 43*c* and 34*c*. The pair of paper feed rollers 31 are driven by the motor 31*a* through the one-way clutch 31*c*. Thus, the paper is conveyed by the conveyance force given by the pair of paper feed rollers 31.

Afterward, the drives of the motors 43*a* and 31*a* are stopped and only the motor 34*a* is driven until the leading edge of the paper is pinched by the pair of sending-in rollers 35. At this time, the shaft 43*b* and the pair of paper feed rollers 31 are freely rotatable by the functions of the one-way clutches 43*c* and 31*c*. The pair of conveyance rollers 34 are driven by the motor 34*a* through the one-way clutch 34*c*. Thus, the paper is conveyed only by the conveyance force given by the pair of conveyance rollers 34.

When the leading edge of the paper is pinched by the pair of sending-in rollers 35, the drives of the motors 43*a*, 31*a*, and 34*a* are stopped and only the motor 35*a* is driven. At this time, the shaft 43*b*, the pair of paper feed rollers 31, and the pair of conveyance rollers 34 are freely rotatable by the functions of the one-way clutches 43*c*, 31*c*, and 34*c*. The pair of sending-in rollers 35 are driven by the motor 35*a* through the one-way clutch 35*c*. Thus, the paper is conveyed only by the conveyance force given by the pair of sending-in rollers 35.

Next, a function of the conveyance control unit 27*a* when the paper is conveyed backward, i.e., upstream in the conveyance direction, will be described with reference to FIGS. 7A to 7G, which show operations of the pair of slacking rollers 33 and the pair of conveyance rollers 34. When the paper is conveyed backward, i.e., upstream in the conveyance direction, the drive of the motor 35*a* is always stopped. In addition, the motor 34*a* is driven such that the conveyance speed V3 of the paper, as shown in FIGS. 7A to 7G, by the rotational power of the pair of conveyance rollers 34, is constant, and the conveyance speed of the paper pinched by the pair of conveyance rollers 34 is controlled not to be higher than V3. Therefore, the pair of conveyance rollers 34 is always driven by the motor 34*a* through the one-way clutch 34*c* and the pair of sending-in rollers 35 are always freely rotatable by the function of the one-way clutch 35*c*. Thus, hereinafter, the description of controls of the motors 34*a* and 35*a* will be omitted.

Figure 7A:
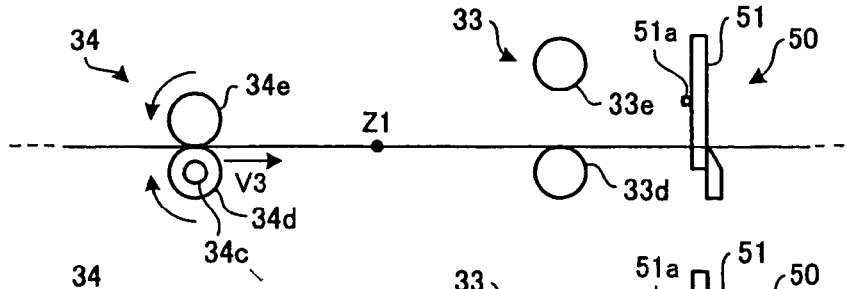
FIGS. 7A to 7G are views showing operations of a pair of slacking rollers and the pair of conveyance rollers when a paper is cut in the printer of FIG. 1.

First, as shown in FIG. 7A, until the rear end of the first image, as shown by Z1 in FIGS. 7A to 7G, reaches the cutting position by the cutting unit 50, the motors 43*a* and 31*a* are controlled such that either of the rewind speed of the paper based on the rotational power of the shaft 43*b* and the conveyance speed of the paper based on the rotational power of the pair of paper feed rollers 31 is equal to the conveyance speed V3 of the paper based on the rotational power of the pair of conveyance rollers 34. At this time, the shaft 43*b* and the pair of paper feed rollers 31 are driven by the motors 43*a* and 31*a* through the one-way clutches 43*c* and 31*c*, respectively. The lift mechanism 33*f* is controlled to put the slave roller 33*e* of the pair of slacking rollers 33 at the withdrawal position. The drive of the motor 33*a* is stopped. Thus, the paper is conveyed backward by the conveyance forces given by the shaft 43*b*, the pair of paper feed rollers 31, and the pair of conveyance rollers 34.

Figure 7B:
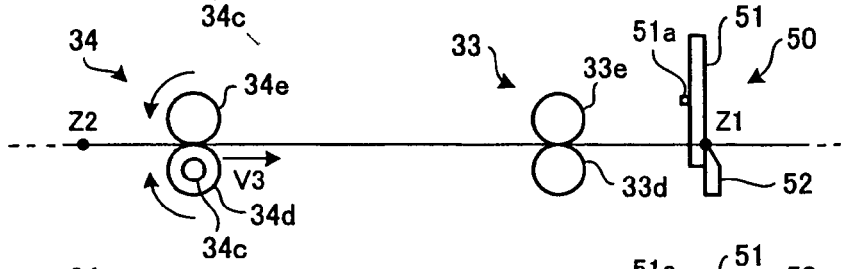
Figure 7C:
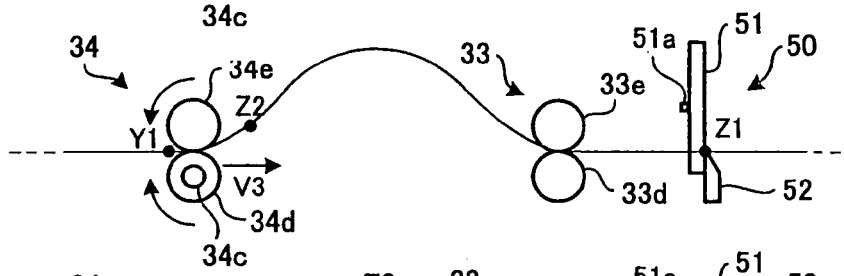

When the rear end Z1 of the first image reaches the cutting position by the cutting unit 50, as shown in FIG. 7B, the lift mechanism 33*f* is controlled to put the slave roller 33*e* of the pair of slacking rollers 33 at the pressing position, and the drives of the motors 43*a*, 31*a*, and 33*a* are stopped. Thus, the portion of the paper upstream in the conveyance direction of the pair of slacking rollers 33 is stopped to be conveyed while the portion of the paper downstream in the conveyance direction of the pair of conveyance rollers 34 is conveyed backward by the conveyance force given by the pair of conveyance rollers 34. As a result, as shown in FIG. 7C, the paper is slacked between the pair of slacking rollers 33 and the pair of conveyance rollers 34.

As will be described later, when the cutting control unit 27*d* detects formation of a slack of a predetermined length by a detection signal from the position sensor 92, the cutting unit 50 cuts the paper at the rear end Z1 of the first image. Afterward, the motors 43*a* and 31*a* are controlled such that the rewind speed of the paper base on the rotational power of the shaft 43*b* is equal to the conveyance speed of the paper based on the rotational power of the pair of paper feed rollers 31. Thus, the shaft 43*b* and the pair of paper feed rollers 31 are driven by the motors 43*a* and 31*a* through the one-way clutches 43*c* and 31*c*, respectively, to rewind the portion of the paper upstream in the conveyance direction of the cutting position, into the paper supply unit 40.

In this embodiment, a slack of a predetermined length means the length of a slack formed when the pressing member 30 is at the protruding position with pushing the paper. The predetermined length is set to a length such that after the slack of the predetermined length is formed and the paper is cut at the rear end of a color image, the slack is not eliminated until the rear end of the color image neighboring on the downstream side in the conveyance direction of the color image at the rear end of which the paper has been cut, reaches the cutting position by the cutting unit 50.

Figure 7D:
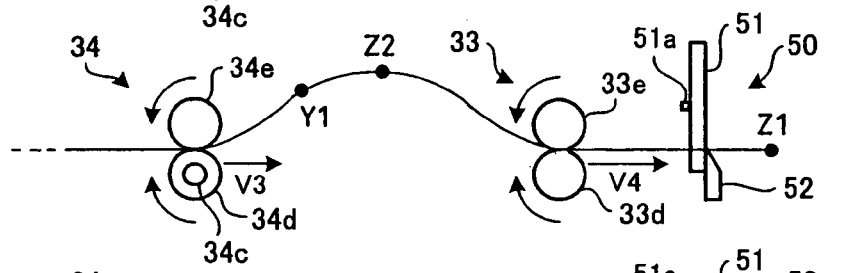

After the paper is cut at the rear end Z1 of the first image, until the front end of the image, as shown by Z2 in FIGS. 7A to 7G, reaches the cutting position by the cutting unit 50, as shown in FIG. 7D, the motor 33*a* is controlled such that the conveyance speed V4 of the paper, as shown in FIGS. 7A to 7G, based on the rotational power of the pair of slacking rollers 33 is higher than the conveyance speed V3 of the paper based on the rotational power of the pair of conveyance rollers 34. Thus, the portion of the paper upstream in the conveyance direction of the pair of conveyance rollers 34 is conveyed backward by the conveyance force given by the pair of slacking rollers 33. On the other hand, the portion of the paper downstream in the conveyance direction of the pair of conveyance rollers 34 is conveyed backward only by the conveyance force given by the pair of conveyance rollers 34. As a result, the slack formed between the pair of slacking rollers 33 and the pair of conveyance rollers 34 is shortened.

Figure 7E:
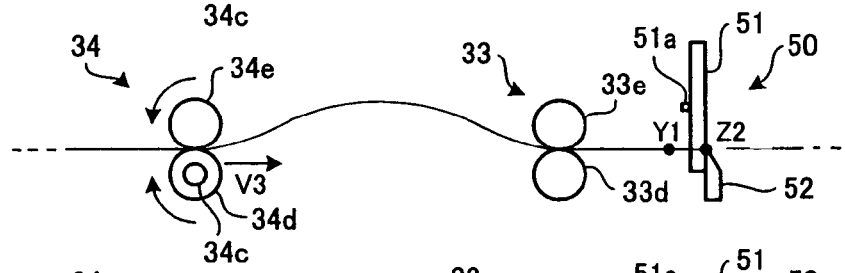

Afterward, when the front end Z2 of the first image reaches the cutting position by the cutting unit 50, the drive of the motor 33*a* is stopped. Thus, as shown in FIG. 7E, the portion of the paper upstream in the conveyance direction of the pair of slacking rollers 33 is stopped to be conveyed while the portion of the paper downstream in the conveyance direction of the pair of conveyance rollers 34 is conveyed backward by the conveyance force given by the pair of conveyance rollers 34. At this time, the paper is cut at the front end Z2 of the first image.

Figure 7F:
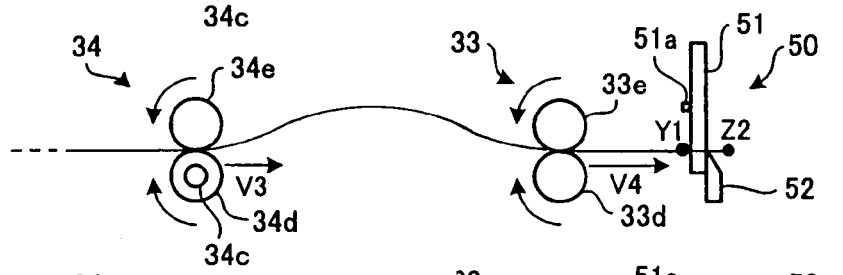

After the paper is cut at the front end Z2 of the first image, until the rear end of the second image, as shown by Y1 in FIGS. 7A to 7G, reaches the cutting position by the cutting unit 50, as shown in FIG. 7F, the motor 33*a* is controlled such that the conveyance speed V4 of the paper based on the rotational power of the pair of slacking rollers 33 is higher than the conveyance speed V3 of the paper based on the rotational power of the pair of conveyance rollers 34. Thus, the portion of the paper upstream in the conveyance direction of the pair of conveyance rollers 34 is conveyed backward by the conveyance force given by the pair of slacking rollers 33. On the other hand, the portion of the paper downstream in the conveyance direction of the pair of conveyance rollers 34 is conveyed backward only by the conveyance force given by the pair of conveyance rollers 34. As a result, the slack formed between the pair of slacking rollers 33 and the pair of conveyance rollers 34 is shortened.

Figure 7G:
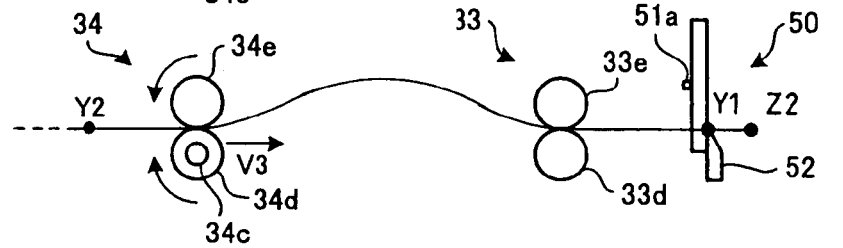

Afterward, when the rear end Y1 of the second image reaches the cutting position by the cutting unit 50, the drive of the motor 33*a* is stopped. Thus, as shown in FIG. 7G, the portion of the paper upstream in the conveyance direction of the pair of slacking rollers 33 is stopped to be conveyed while the portion of the paper downstream in the conveyance direction of the conveyance rollers 34 is conveyed backward by the conveyance force given by the pair of conveyance rollers 34. As a result, the slack formed between the pair of slacking rollers 33 and the pair of conveyance rollers 34 is again lengthened. Afterward, when a slack of a predetermined length is formed, the paper is cut by the cutting unit 50 at the rear end Y1 of the second image.

Afterward, the conveyance control unit 27*a* controls the motor 33*a* to repeat the operation of the pair of slacking rollers 33 as shown in FIGS. 7A to 7G. Thereby, the paper is conveyed backward, i.e., upstream in the conveyance direction with conveying the portion of the paper downstream in the conveyance direction of the pair of conveyance rollers 34 at the constant speed V3 and forming a slack between the pair of slacking rollers 33 and the pair of conveyance rollers 34. the printing control unit 27*b* controls the timings of lifting up and down the thermal head 61*a* of the overcoating unit 60 and the thermal heads 71*a* to 73*a* of the printing unit 70, and the timings of printing by the thermal heads 61*a* and 71*a* to 73*a*. More specifically, the printing control unit 27*b* controls the timings of lifting up and down the thermal heads 61*a* and 71*a* to 73*a* such that the thermal heads 61*a* and 71*a* to 73*a* are at their withdrawal positions while the paper is conveyed downstream in the conveyance direction, and put at their operative positions before the paper is conveyed backward, i.e., upstream in the conveyance direction. In addition, the printing control unit 27*b* controls the timings of printing by the thermal heads 71*a* to 73*a* such that a plurality of frames of color images contained in one order are printed at intervals each corresponding to the length of a margin and no image is printed in a region corresponding to the additional length nearer to the leading edge of the paper than the last printed color image. Further, the printing control unit 27*b* controls the overcoating unit 60 such that an overcoating is applied only on each region of the paper on which a color image has been printed.

The position control unit 27*c* controls timings of moving up and down the pressing member 39. More specifically, the position control unit 27*c* puts the pressing member 39 at the withdrawal position until the rear end of a color image printed on the paper reaches the cutting position by the cutting unit 50. After the rear end of the color image reaches the cutting position by the cutting unit 50, the position control unit 27*c* controls the lift mechanism 39*a* to move the pressing member 39 from the withdrawal position to the protruding position. At this time, the movement speed of the pressing member 39 is controlled such that the pair of conveyance rollers 34 do not become freely rotatable by the function of the one-way clutch 34*c*. Afterward, when the position sensor 92 detects the pressing member 39 having reached the protruding position, the position control unit 27*c* controls the lift mechanism 39*a* to return the pressing member 30 to the withdrawal position.

The cutting control unit 27*d* detects the rear or front end of a color image, at which the paper is to be cut, having reached the cutting position by the cutting unit 50, and controls timings of cutting by the cutting unit 50.

More specifically, on the basis of the number of revolutions of the pair of conveyance rollers 34 detected by the encoder 37 after the conveyance direction of the paper is switched over from the forward direction to the backward direction, the cutting control unit 27*d* detects, from the conveyance quantity of the paper detected by the conveyance quantity detecting unit 26, that the rear end of the first image has reached the cutting position by the cutting unit 50. On the other hand, on the basis of the number of revolutions of the pair of slaking rollers 33 detected by the encoder 36 after the image sensor 90 detects the rear end of the color image, the cutting control unit 27*d* detects, from the conveyance quantity detected by the conveyance quantity detecting unit 26, that the front end of the color image has reached the cutting position by the cutting unit 50. Further, on the basis of the number of revolutions of the pair of slacking rollers 33 detected by the encoder 36 after the paper is cut at the front end of the color image, the cutting control unit 27*d* detects, from the conveyance quantity detected by the conveyance quantity detecting unit 26, that the rear end of the color image printed on the downstream side in the conveyance direction of the first image has reached the cutting position by the cutting unit 50.

After it is detected that the rear end of the color image has reached the cutting position by the cutting unit 50, when the position sensor 92 detects that the pressing member 39 has reached the protruding position and a slack of a predetermined length has been formed, the cutting control unit 27*d* controls the cutting unit 50 to cut the paper at the rear end of the color image. On the other hand, when it is detected that the front end of the color image has reached the cutting position by the cutting unit 50, the cutting control unit 27*d* controls the cutting unit 50 to cut the paper at the front end of the color image.

Figure 8:
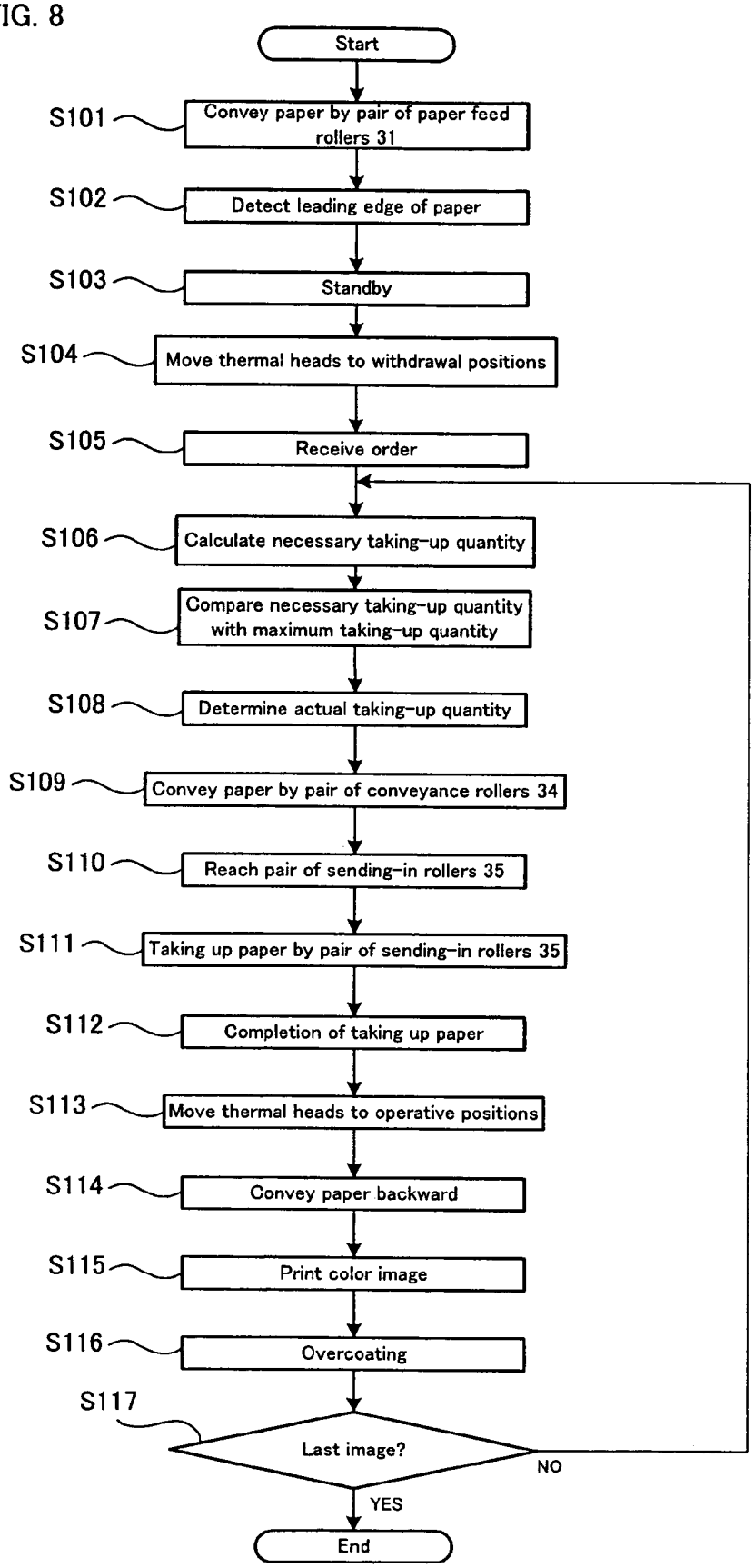
FIG. 8 is a flowchart of a procedure of an operation of the printer of FIG. 1.

Next, an operation of the printer 1 for printing images will be described with reference to FIG. 8. FIG. 8 is a flowchart of a procedure of an image printing operation of the printer 1.

First, the leading portion of the paper unwound from the paper roll 45 put in the paper supply unit 40, by driving the shaft 43*b* to rotate, is conveyed only by the conveyance force by the pair of paper feed rollers 31, in Step S101. The conveyance by the pair of paper feed rollers 31 continues until the leading edge of the paper passes through the pair of conveyance rollers 34 and reaches the detection position of the paper sensor 91, in Step S102. When the paper sensor 91 detects the leading edge of the paper, the paper sensor 91 sends, to the controller 20, a detection signal indicating that the leading edge of the paper has been detected.

At the time when the leading edge of the paper reaches the detection position of the paper sensor 91, the conveyance of the paper is stopped and the printer 1 falls in a standby state, in Step S103. At this time, if the thermal heads 61*a* and 71*a* to 73*a* are at their operative positions, they are moved to their withdrawal positions, in Step S104.

Afterward, an order is received from an operator and a print kind and the number of prints of color images contained in one order are input, in Step S105. As a preparation for starting the conveyance of the paper, the necessary taking-up quantity calculation unit 23 then calculates a necessary taking-up quantity corresponding to the one order on the basis of information stored in the print information storage unit 22, in Step S106. The comparing unit 24 then compares the necessary taking-up quantity with the maximum taking-up quantity stored in the maximum taking-up quantity storage unit 21, in Step S107. On the basis of the comparison result, the taking-up quantity determining unit 25 determines an actual taking-up quantity, in Step S108. After the preparation for the conveyance of the paper is thus completed, the paper is conveyed only by the conveyance force given by the pair of conveyance rollers 34, in Step S109. At this time, either of the shaft 43*b* of the paper supply unit 40 and the pair of paper feed rollers 31 is freely rotatable.

Afterward, while the thermal heads 61*a* and 71*a* to 73*a* are at their withdrawal positions, the paper is continued to be conveyed only by the conveyance force given by the pair of conveyance rollers 34 until the leading portion of the paper passes through the overcoating unit 60 and the printing unit 70 without overcoating and printing operations and reaches the pair of sending-in rollers 35, in Step S110. After the leading portion of the paper reaches the pair of sending-in rollers 35 and is pinched by the pair of sending-in rollers 35, the paper is conveyed only by the conveyance force given by the pair of sending-in rollers 35, to be sent in the housing case 81 of the paper taking-up unit 80 in order from the leading portion of the paper, in Step S111. As the paper is sent in the housing case 81, the leading edge of the paper is guided by the inner circumferential surface of the housing case 81 and the taking-up rollers 83*a* to 83*d* and the paper is taken up in accordance with its curling tendency. At the time when the leading edge of the paper reaches the pair of sending-in rollers 35, the pair of conveyance rollers 34 are switched by the function of the one-way clutch 34*c* from a state of giving the paper the conveyance force to a state of rotating by following the paper being conveyed by the pair of sending-in rollers 35.

Afterward, at the time when a length of the paper corresponding to the taking-up quantity determined by the taking-up quantity determining unit 25 is conveyed downstream in the conveyance direction of the printing position by the print head 73, taking up the paper is completed and the forward conveyance of the paper is stopped, in Step S112. That is, at the time when the conveyance quantity detecting unit 26 detects that the conveyance quantity of the paper detected on the basis of the number of revolutions of the pair of conveyance rollers 34 detected by the encoder 37 after the paper sensor 91 detects the leading edge of the paper, becomes equal to the length obtained by summing the taking-up quantity determined by the taking-up quantity determining unit 25 and the length of the conveyance path in the overcoating unit 60 and the printing unit 70, the conveyance control unit 27*a* stops taking up the paper to stop the forward conveyance of the paper. At this time, the print head 73 is opposed to the rear end of an image to be printed on the most upstream portion in the conveyance direction of the paper of the length corresponding to the taking-up quantity.

The thermal head 61*a* of the overcoating unit 60 and the thermal heads 71*a* to 73*a* of the printing unit 70 are then moved from their withdrawal positions to their operative positions at once, in Step S113. Afterward, the paper is started to be conveyed backward, i.e., upstream in the conveyance direction, by the conveyance force given by the pair of paper feed rollers 31 and the pair of conveyance rollers 34, in Step S114. At this time, the pair of paper feed rollers 31 and the pair of conveyance rollers 34, which were freely rotatable, are driven to rotate so as to convey the paper upstream in the conveyance direction. On the other hand, the pair of sending-in rollers 35 become freely rotatable by the function of the one-way clutch 35*c*. In addition, the shaft 43*b* of the paper supply unit 40 is driven to rotate so as to rewind up the paper in the magazine case 41.

While the paper is conveyed backward, i.e., upstream in the conveyance direction, each color image contained in one order is printed in the manner that printing corresponding to yellow by the print head 73, printing corresponding to magenta by the print head 72, and printing corresponding to cyan by the print head 71 are performed in this order. Each color image is thus completed by printing in the order of yellow, magenta, and cyan, in Step S115. Subsequently, the overcoating head 61 applies an overcoating on the surface of the paper on which the color image has been printed, in Step S116.

In this embodiment, when the necessary taking-up quantity is less than the maximum taking-up quantity, printing color images is started simultaneously with start of conveying the paper backward, i.e., upstream in the conveyance direction, and all of a plurality of frames of color images contained in one order are intermittently printed so that a predetermined margin is formed in each interval between the images. Contrastingly, when the necessary taking-up quantity is more than the maximum taking-up quantity, printing color images is started simultaneously with start of conveying the paper backward, i.e., upstream in the conveyance direction, and part of a plurality of frames of color images contained in one order are intermittently printed so that a predetermined margin is formed in each interval between the images. That is, as described before, the color images are printed on the paper so that an image region and a margin are alternately disposed. But, no image is printed in a region corresponding to the additional length for heat radiation of the head, near the leading edge of the paper. In the printing unit 70, if image regions continue to face at least two of the three print heads 71 to 73 at the same timing, the two print heads operate at once to print. On the other hand, overcoating by the overcoating unit 60 may be performed in parallel with printing color images by the printing unit 70. Thus, in the printing unit 70 and the overcoating unit 60, printing and overcoating are performed for a plurality of frames of color images that can be printed on the paper of the length corresponding to the taking-up quantity determined by the taking-up quantity determining unit 25 or the paper of the length corresponding to the maximum taking-up quantity.

The paper on which the plurality of frames of color images have been printed and the overcoating has been applied as described above, is cut in the cutting unit 50 into each piece on which one image has been printed, by a procedure as will be described later in detail. After the paper is cut at the front end of the last image printed at the nearest position to the leading edge of the paper, it is judged in Step S117 whether or not printing all the color images contained in one order has been completed. If printing all the color images contained in one order is judged not to have been completed, the flow then returns to Step S106 and the same procedure as described above is repeated. When printing all the color images contained in one order is judged to have been completed, the flow then ends.

The case wherein printing all the color images contained in one order is judged in Step S117 not to have been completed, is, for example, a case wherein the comparing unit 24 has judged the necessary taking-up quantity to be longer than the maximum taking-up quantity and the taking-up quantity determining unit 25 has adopted the maximum taking-up quantity as the final taking-up quantity. In this case, the remaining color images of the color images contained in one order, that could not be printed on the paper of the length of the maximum taking-up quantity, are printed subsequently. Until printing all the color images contained in one order is thus completed, the same procedure as described above is repeated.

Figure 9:
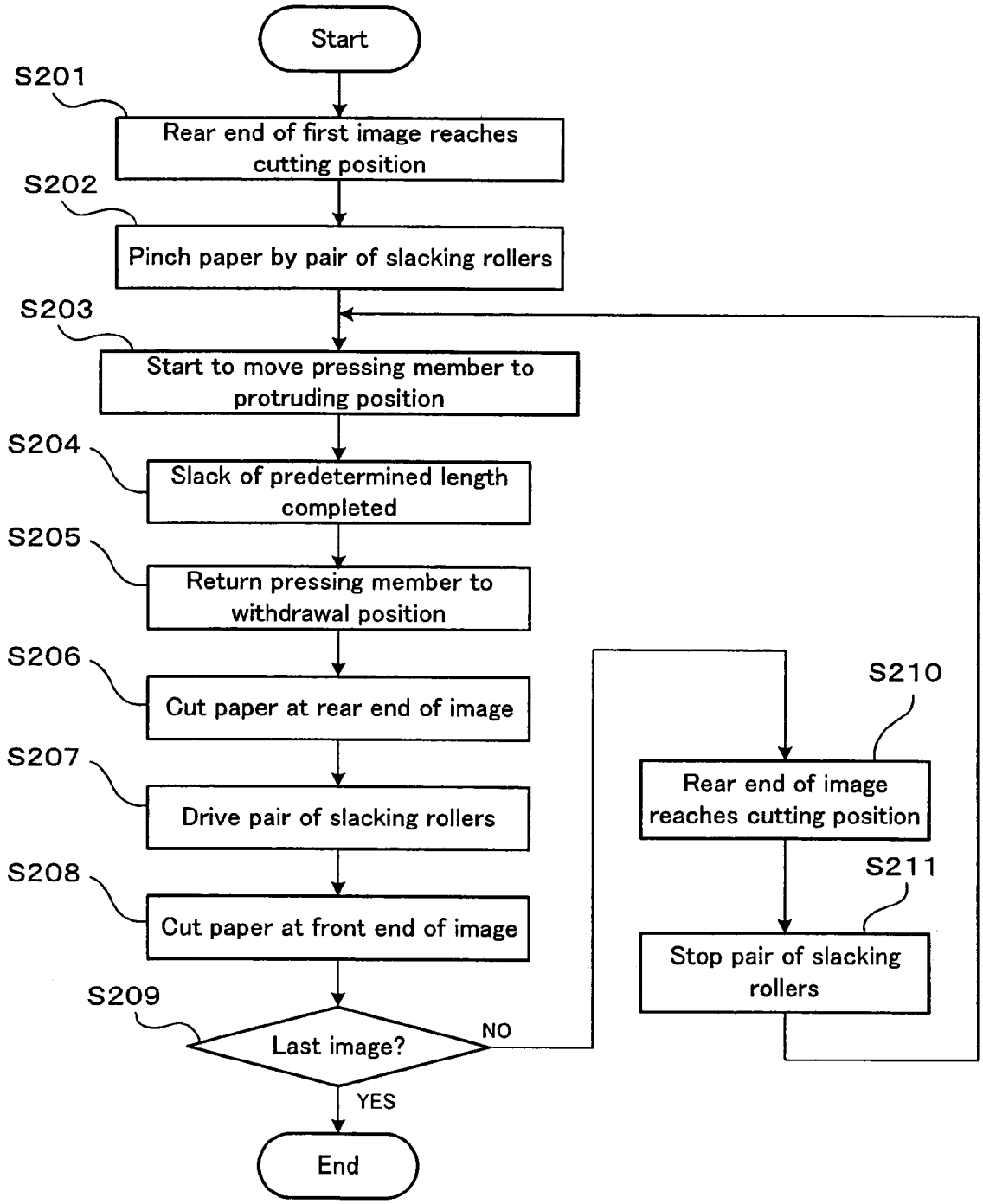
FIG. 9 is a flowchart of a procedure of a paper cutting operation in the printer of FIG. 1.

Next, a paper cutting operation in the printer 1 will be described with reference to FIG. 9. FIG. 9 is a flowchart of a procedure of an operation of cutting the paper on which images have been printed.

Subsequently after the overcoating is applied on the surface of the paper on which the color images have been printed, in Step S116 of the above-described image printing operation, the paper is conveyed backward, i.e., upstream in the conveyance direction, by the conveyance forces given by the pair of paper feed rollers 31 and the pair of conveyance rollers 34. When the rear end of the first image, which coincides with the rear end of the paper of a length corresponding to the taking-up quantity determined by the taking-up quantity determining unit 25, reaches the cutting position by the cutting unit 50, in Step S201, the slave roller 33*e* of the pair of slacking rollers 33, which was put at the withdrawal position, is put at the pressing position, in Step S202. The timing when the rear end of the color image reaches the cutting position by the cutting unit 50 is detected on the basis of the conveyance quantity detected by the conveyance quantity detecting unit 26. At this time, the portion of the paper upstream in the conveyance direction of the pair of slacking rollers 33 is stopped to be conveyed backward while the portion of the paper downstream in the conveyance direction of the pair of conveyance rollers 34 is conveyed backward only by the conveyance force given by the pair of conveyance rollers 34. As a result, a slack is formed between the pair of slacking rollers 33 and the pair of conveyance rollers 34. Further, at this time, the pressing member 39, which was put at the withdrawal position, starts to be moved to the protruding position, in Step S203.

Afterward, when the position sensor 92 detects the pressing member 39 having reached the protruding position and formation of a slack of a predetermined length is completed, in Step S204, the pressing member 39, which was put at the protruding position, is returned to the withdrawal position, in Step S205. At this time, the paper is cut at the rear end of the color image, in Step S206. After the paper is thus cut, the portion of the paper upstream in the conveyance direction of the color image printed at the most upstream position in the conveyance direction, on which no image has been printed, i.e., the portion of the paper upstream in the conveyance direction of the rear end of the paper of the length corresponding to the taking-up quantity determined by the taking-up quantity determining unit 25, is rewound in the paper supply unit 40.

The pair of slacking rollers 33 is then started to be driven, in Step S207. Thus, the portion of the paper upstream in the conveyance direction of the pair of conveyance rollers 34 is conveyed backward by the conveyance force given by the pair of slacking rollers 33 while the portion of the paper downstream in the conveyance direction of the pair of conveyance rollers 34 is conveyed backward only by the conveyance force given by the pair of conveyance rollers 34. At this time, because the conveyance control unit 27*a* is making control such that the conveyance speed of the paper upstream in the conveyance direction of the pair of conveyance rollers 34 is higher than the conveyance speed of the paper downstream in the conveyance direction of the pair of conveyance rollers 34, the slack is shortened.

When the rear end of the image at the most upstream position in the conveyance direction reaches the detection position of the image sensor 90, the image sensor 90 transmits, to the controller 20, a detection signal indicating that the rear end of the image has been detected. The conveyance quantity detecting unit 26 then detects a conveyance quantity of the paper upstream in the conveyance direction, on the basis of the number of revolutions of the pair of slacking rollers 33 detected by the encoder 36 after the image sensor 90 detects the rear end of the image. On the basis of the conveyance quantity, the cutting control unit 27*d* detects that the rear end of the color image has reached the cutting position by the cutting unit 50. At this time, the drive of the pair of slacking rollers 33 is stopped. The paper is then stopped to be conveyed backward upstream in the conveyance direction of the pair of slacking rollers 33, and the paper is cut at the front end of the color image, in Step S208. The piece of the paper thus cut at the front and rear ends of the color image is discharged in the print box 96.

Every time when the paper is thus cut at the front end of a color image, it is judged in Step S209 whether or not the color image printed on the cut-off paper is the last image printed at the nearest position to the leading edge of the paper. If the image is judged not to be the last image, the pair of slacking rollers 33 is started to be again driven. The conveyance quantity detecting unit 26 then detects a conveyance quantity of the paper upstream in the conveyance direction on the basis of the number of revolutions of the pair of slacking rollers 33 detected by the encoder 36 after the paper is cut at the front end of the color image. On the basis of the conveyance quantity, the cutting control unit 27*d* detects in Step S210 that the rear end of the color image neighboring the downstream side in the conveyance direction of the color image at the front end of which the paper was cut, reaches the cutting position by the cutting unit 50. At this time, the drive of the pair of slacking rollers 33 is stopped and thereby the paper is stopped to be conveyed backward upstream in the conveyance direction of the pair of slacking rollers 33, in Step S211. As a result, the slack formed between the pair of slacking rollers 33 and the pair of conveyance rollers 34 is again lengthened. The flow then returns to Step S203 and the same procedure as described above is repeated.

On the other hand, in Step S209, when the image is judged to be the last image, the flow of this procedure for cutting the paper ends. The flow then returns to the above-described main flow of the image printing operation and the main flow advances to Step S117.

As described above, in the printer 1 of this embodiment, after the paper is conveyed forward, a plurality of frames of color images can be printed on the paper being conveyed backward by the conveyance force by the pair of conveyance rollers 34 disposed upstream in the conveyance direction of the overcoating unit 60 and the printing unit 70. Therefore, the color images can be printed on the whole region from the position opposed to the print head 73 at the time when the backward conveyance of the paper is started, to the leading edge of the paper. In addition, because no variation of load occurs in the conveyance of the paper, good images can be printed. Further, a plurality of frames of color images can be recorded on the paper by one recording operation corresponding to one set of forward and backward movements of the paper. Thus, the time loss attendant upon switchover of the conveyance direction in the conveyance mechanism 38 can be reduced and a plurality of frames of color images can be recorded with a high processing performance.

In addition, the cutting unit 50 is disposed between the paper supply unit 40 and the overcoating unit 60 to cut the paper on which color images have been printed. While the paper is conveyed backward, i.e., upstream in the conveyance direction, the printing unit 70 prints color images on the paper and the overcoating unit 60 applies an overcoating on the paper. Thereafter, the paper is cut in the cutting unit 50 and then the cut-off paper is further conveyed backward, i.e., upstream in the conveyance direction, to be discharged. Thus, it is not troublesome to deal with the paper after color image printing.

Further, positional deviation of the paper, which may occur when the paper is cut in the cutting unit 50, is absorbed by a slack and not brought to a region opposite to the printing unit 70. Thus, the images can be prevented from being deteriorated due to the positional deviation having occurred attendant upon cutting the paper. Besides, when the printing unit 70 prints color images on the paper, the portion of the paper downstream in the conveyance direction of the pair of conveyance rollers 34 is always being conveyed backward by the conveyance force given by the pair of conveyance rollers 34. Thus, it needs not be interrupted to convey the paper backward and print the color images in the printing unit 70. This prevents the processing performance from being lowered.

Further, between the cutting unit 50 and the overcoating unit 60, the pair of slacking rollers 33, which can be driven by the motor 33*a* to rotate, and the pair of conveyance rollers 34, which can be driven by the motor 34*a* to rotate, are disposed in this order along the Conveyance direction. The motors 33*a* and 34*a* are controlled by the conveyance control unit 27*a* independently of each other. Thus, a slack can be easily formed.

Further, the conveyance speed of the paper by the pair of slacking rollers 33 is controlled to be higher than the conveyance speed of the paper by the pair of conveyance rollers 34 until the front end of a color image reaches the cutting position by the cutting unit 50 after the paper is cut at the rear end of the image, or until the rear end of a color image reaches the cutting position by the cutting unit 50 after the paper is cut at the front end of the preceding image. Thus, the slack can be prevented from being excessively lengthened.

Further, on the basis of the number of revolutions of the pair of conveyance rollers 34 detected by the encoder 37 or the number of revolutions of the pair of slacking rollers 33 detected by the encoder 36, the cutting control unit 27*d* detects, from the conveyance quantity of the paper detected by the conveyance quantity detecting unit 26, that the front or rear end of a color image at which the paper is to be cut reaches the cutting position by the cutting unit 50. Therefore, the efficiency of the operation of cutting the paper can be improved. In addition, each position of the paper to be cut can be determined with high accuracy.

Further, each of the slacking rollers 33 and conveyance rollers 34 is made of metal. Therefore, the diameter of each of the slacking rollers 33 and conveyance rollers 34 scarcely varies because of wear or the like, and thus each position of the paper to be cut can be determined with higher accuracy.

Further, the cutting unit 50 cuts the paper at the front and rear ends of each color image printed on the paper. Thus, the paper on which a plurality of frames of color images have been printed can be separated into pieces on each of which only one image has been printed, and then the pieces of the paper can be discharged.

Further, the paper supply unit 40 includes the shaft 43*b* on which the paper is wound. The shaft 43*b* is driven by the motor 43*a* to rotate so as to unwind the paper from the paper supply unit 40 or take up the paper in the paper supply unit 40. Thus, the paper can be sent out of the paper supply unit 40 and the paper having been conveyed downstream in the conveyance direction can be taken up in the paper supply unit 40. Thereby, a slack of the paper can be prevented from being formed near the paper supply unit 40 when the paper is conveyed backward, i.e., upstream in the conveyance direction. In addition, after the cutting unit 50 cuts the paper at the rear end of the color image printed at the most upstream position in the conveyance direction, the portion of the paper upstream in the conveyance direction of the cut position can be taken up in the paper supply unit 40. Therefore, adhesion of dust or the like to the paper can be prevented, which may occur if a portion of the paper is left outside the paper supply unit 40 for a long time. In addition, when the paper is taken up in the paper supply unit 40, the paper can be smoothly taken up without bending the paper.

Further, the pressing member 39 can be moved by the lift mechanism 39*a* between the protruding position and the withdrawal position. The lift mechanism 39*a* is controlled by the position control unit 27*c* to move the pressing member 39 from the withdrawal position to the protruding position after the rear end of a color image reaches the cutting position by the cutting unit 50 and the drive of the pair of slacking rollers 33 is stopped, and to return the pressing member 39 from the protruding position to the withdrawal position after a slack of a predetermined length is formed. Thus, the slack can be formed to be always convex to the same side, and thus it is easy to detect the slack.

Further, the position sensor 92 is provided that can detect the pressing member 39 having reached the protruding position. Therefore, it can be checked that a slack of a predetermined length has been surely formed.

Further, the guides 39*b* are provided near the pair of slacking rollers 33 and the pair of conveyance rollers 34, respectively. The guides 39*b* are disposed near the segment A on the same side of the segment A as the front end of the pressing member 39 being at the protruding position, so as to be in contact with the paper when the pressing member 39 is at the protruding position. Thus, a slack having a substantially fixed shape can be formed. As a result, when the position sensor 92 detects the pressing member 39 having reached the protruding position, it is hard to generate an error in the length of the slack then formed.

In the above-described embodiment, the conveyance control unit 27*a* controls the conveyance mechanism 38 to convey the paper backward with forming a slack between the cutting unit 50 and the overcoating unit 60. In a modification, however, no slack may be formed between the cutting unit 50 and the overcoating unit 60.

In the above-described embodiment, a slack is formed between two pairs of rollers controllable independently of each other, that is, the pair of slacking rollers 33 that can be driven by the motor 33*a* to rotate, and the pair of conveyance rollers 34 that can be driven by the motor 34*a* to rotate. However, the present invention is not limited to this. In a modification, both of the pair of slacking rollers 33 and the pair of conveyance rollers 34 may be driven by a single motor to rotate.

In the above-described embodiment, the conveyance speed of the paper by the pair of slacking rollers 33 is controlled to be higher than the conveyance speed of the paper by the pair of conveyance rollers 34 until the front end of a color image reaches the cutting position after the paper is cut at the rear end of the image, or until the rear end of a color image reaches the cutting position after the paper is cut at the front end of the preceding image. However, the present invention is not limited to this. In a modification, the conveyance speed of the paper by the pair of slacking rollers 33 may be always controlled to be lower than the conveyance speed of the paper by the pair of conveyance rollers 34.

In the above-described embodiment, a slack is formed by stopping the drive of the pair of slacking rollers 33. However, the present invention is not limited to this. In a modification, for example, a slack may be formed by driving the pair of slacking rollers 33 such that the conveyance speed of the paper by the pair of slacking rollers 33 is lower than the conveyance speed of the paper by the pair of conveyance rollers 34.

In the above-described embodiment, a slack of a predetermined length is formed after the rear end of a color image printed on the paper reaches the cutting position. However, the timing of forming a slack of a predetermined length is not limited to this. It suffices if a slack is formed between the cutting unit 50 and the overcoating unit 60 when the paper is cut.

In the above-described embodiment, on the basis of the number of revolutions of the pair of conveyance rollers 34 detected by the encoder 37 or the number of revolutions of the pair of slacking rollers 33 detected by the encoder 36, the cutting control unit 27*d* detects, from the conveyance quantity of the paper detected by the conveyance quantity detecting unit 26, that the front or rear end of a color image at which the paper is to be cut reaches the cutting position by the cutting unit 50. However, the present invention is not limited to this. In a modification, for example, a sensor provided at the cutting position by the cutting unit 50 may detect that a position of the paper to be cut reaches the cutting position by the cutting unit 50.

In the above-described embodiment, each of the slacking rollers 33 and conveyance rollers 34 is made of metal. However, the present invention is not limited to this. In a modification, each of the slacking rollers 33 and conveyance rollers 34 may be made of a resin.

In the above-described embodiment, the cutting unit 50 cuts the paper at the front and rear ends of each color image printed on the paper. However, the present invention is not limited to this. In a modification, for example, the paper may be cut only at the rear end of the color image printed at the most upstream position in the conveyance direction. In this case, the cut-off paper is discharged without separating a plurality of frames of color images printed on the paper. In another modification, the paper may be cut only once in each region corresponding to a margin provided between color images and in a region more upstream than the rear end of the color image printed at the most upstream position in the conveyance direction.

In the above-described embodiment, the paper supply unit 40 includes the shaft 43*b* on which the paper is wound. The shaft 43*b* is driven by the motor 43*a* to rotate so as to unwind the paper from the paper supply unit 40 or take up the paper in the paper supply unit 40. However, the present invention is not limited to this. The above-described construction is merely an example for taking up the paper in the paper supply unit 40. The construction may be arbitrarily modified. In a modification, for example, the shaft 43*b* can only be driven to rotate so as to take up the paper in the paper supply unit 40. In another modification, a mechanism not including such a shaft 43*b* may be used in which, for example, the paper is sent in the paper supply unit 40 by a plurality of pairs of conveyance rollers. In still another modification, no mechanism for taking up the paper in the paper supply unit 40 may be used.

In the above-described embodiment, when the paper is cut, the backward conveyance of the paper is stopped. However, the present invention is not limited to this. In a modification, the paper may be cut in the cutting unit 50 while the paper is being conveyed backward and color images are printed on the paper.

In the above-described embodiment, the pressing member 39 is provided that can selectively take the withdrawal position and the protruding position. In a modification, however, such a pressing member 39 may not be provided.

In the above-described embodiment, the position sensor 92 can detect the pressing member 39 having reached the protruding position. However, the present invention is not limited to this. In a modification, the position sensor 92 can detect the front end of the pressing member 39 having reached a position near the segment A on the same side of the segment A as the front end of the pressing member 39 protruding beyond the segment A. In another modification, the position sensor 92 can detect a peak of the convex portion of a slack having reached a position farther from the segment A than the front end of the pressing member 39 being at the protruding position. In still another modification, such a position sensor 92 may not be used.

In the above-described embodiment, the guides 39*b* are disposed on the same side of the segment A as the front end of the pressing member 39 being at the protruding position, so as to be in contact with a slack when the front end of the pressing member 39 is at the protruding position. In a modification, however, such guides 39*b* may not be provided.

In the above-described embodiment, the overcoating unit 60 is disposed between the cutting unit 50 and the printing unit 70. However, the positional relation among the cutting unit 50, the overcoating unit 60, and the printing unit 70 is not limited to this. In a modification, the cutting unit 50 may be disposed between the printing unit 70 and the overcoating unit 60. In this case, a color image is printed on the paper; the paper is cut at the front and rear ends of the color image; and then an overcoating is applied on the surface of the cut-off paper.

In the above-described embodiment, the print unit 30 includes the overcoating unit 60. However, the present invention is not limited to this. In a modification, the print unit 30 may not include such an overcoating unit 60.

In the above-described embodiment, the overcoating unit 60 applies an overcoating on the surface of the paper on which a color image has been printed, by an overcoating head 61 including the ribbon 61*c* having thereon the ink region to which colorless, transparent ink has adhered. However, the construction for overcoating can be arbitrarily modified. For example, the overcoating unit may be for laminating a surface of a recording medium on which color images have been recorded.

In the above-described embodiment, a plurality of frames of color images are printed with providing a region corresponding to an additional length for heat radiation of head, near the leading edge of the paper, and forming a margin between each neighboring images. In a modification, however, such a region corresponding to an additional length for heat radiation of head may not be provided. In addition, no margin between each neighboring images may not be formed.

In the above-described embodiment, the dye sublimation printer 1 prints a color image by three print heads 71 to 73 that are brought into contact with a paper as a recording medium. However, the construction of the image recording unit of the printer is not limited to this as far as it can record a color image. Therefore, the present invention can be applied to printers each having a print head or heads to be brought into contact with a recording medium, including thermal transfer printers and thermal printers; and also to printers each having an inkjet head, a fiber optic cathode ray tube (FOCRT), a laser source, or the like, for printing a color image without being in contact with a recording medium. In addition, the image recording unit need not always have a plurality of image recording heads. The image recording unit may have only one image recording head capable of recording a color image. For example, a printer according to the present invention may have three inkjet heads having nozzles capable of ejecting inks of yellow, magenta, and cyan, respectively, and the heads are reciprocated across the conveyance path of a recording medium to print a color image. Alternatively, a printer according to the present invention may have a single inkjet head having nozzles capable of ejecting inks of yellow, magenta, and cyan, and the head is reciprocated across the conveyance path of a recording medium to print a color image.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A printer comprising:

a supply unit storing therein a long recording medium;

an image recording unit capable of recording a color image on the recording medium;

a cutting unit disposed between the supply unit and the image recording unit and capable of cutting the recording medium;

a conveyance mechanism capable of conveying the recording medium in a first direction from the supply unit toward the image recording unit and in a second direction reverse to the first direction, with opposing the recording medium to the image recording unit;

a conveyance controller that controls the conveyance mechanism to convey the recording medium in the first direction until a leading edge of the recording medium reaches a position distant in the first direction from the image recording unit, and then convey the recording medium in the second direction;

an image recording controller that controls the image recording unit to record a plurality of frames of color images on the recording medium being conveyed in the second direction by the conveyance mechanism; and a cutting controller that controls the cutting unit to cut the recording medium being conveyed in the second direction by the conveyance mechanism while the image recording unit is recording the plurality of frames of color images on the recording medium.

2. The printer according to claim 1, wherein the conveyance controller controls the conveyance mechanism to form a slack portion of the recording medium being conveyed in the second direction, between the image recording unit and the cutting unit.

3. The printer according to claim 2, wherein the conveyance mechanism comprises:

a first pair of conveyance rollers that can pinch the recording medium between the cutting unit and the image recording unit and rotate to give a conveyance force to the recording medium; and a second pair of conveyance rollers that can pinch the recording medium between the cutting unit and the first pair of conveyance rollers and rotate to give a conveyance force to the recording medium, and the conveyance controller can control the first and second pairs of conveyance rollers independently of each other.

4. The printer according to claim 3, wherein the conveyance controller controls the conveyance mechanism such that a conveyance speed of the recording medium by the second pair of conveyance rollers is higher than a conveyance speed of the recording medium by the first pair of conveyance rollers.

5. The printer according claim 2, wherein the slack portion is formed by the conveyance mechanism before the recording medium being conveyed in the second direction is cut by the cutting unit.

6. The printer according to claim 1, wherein the supply unit stores therein the long recording medium in a state of being wound, and comprises a taking-up mechanism capable of taking up the recording medium being conveyed in the second direction by the conveyance mechanism.

7. The printer according to claim 6, wherein the taking-up mechanism comprises:

a shaft on which the recording medium is wound; and a drive source capable of driving the shaft to rotate so as to take up the recording medium that was unwound from the shaft.

8. A printer comprising:

a supply unit storing therein a long recording medium;

an image recording unit capable of recording a color image on the recording medium;

a cutting unit disposed between the supply unit and the image recording unit and capable of cutting the recording medium;

a conveyance mechanism capable of conveying the recording medium in a first direction from the supply unit toward the image recording unit and in a second direction reverse to the first direction, with opposing the recording medium to the image recording unit;

a conveyance controller that controls the conveyance mechanism to convey the recording medium in the first direction until a leading edge of the recording medium reaches a position distant in the first direction from the image recording unit, and then convey the recording medium in the second direction;

an image recording controller that controls the image recording unit to record a plurality of frames of color images on the recording medium being conveyed in the second direction by the conveyance mechanism; and a cutting controller that controls the cutting unit to cut the recording medium being conveyed in the second direction by the conveyance mechanism, wherein the conveyance controller controls the conveyance mechanism to form a slack portion of the recording medium being conveyed in the second direction, between the image recording unit and the cutting unit, wherein the conveyance mechanism comprises:

a first pair of conveyance rollers that can pinch the recording medium between the cutting unit and the image recording unit and rotate to give a conveyance force to the recording medium; and a second pair of conveyance rollers that can pinch the recording medium between the cutting unit and the first pair of conveyance rollers and rotate to give a conveyance force to the recording medium, and the conveyance controller can control the first and second pairs of conveyance rollers independently of each other, wherein the printer further comprises:

a revolution number detector capable of detecting the number of revolutions of the second pair of conveyance rollers; and a detector capable of detecting a conveyance quantity of the recording medium on the basis of the number of revolutions detected by the revolution number detector, and the cutting controller detects, on the basis of the conveyance quantity detected by the detector, a portion of the recording medium to be cut having reached a cutting position by the cutting unit, and controls the cutting unit to cut the recording medium at the portion to be cut.

9. The printer according to claim 8, wherein each of the conveyance rollers in the second pair is made of metal.

10. The printer according to claim 8, wherein the cutting controller sets at least one portion of the recording medium to be cut, between each pair of neighboring color images, and a portion of the recording medium to be cut, at a position nearer to the supply unit than the color image printed at the nearest position to the supply unit.

11. A printer comprising:

a supply unit storing therein a long recording medium;

an image recording unit capable of recording a color image on the recording medium;

a cutting unit disposed between the supply unit and the image recording unit and capable of cutting the recording medium;

a conveyance mechanism capable of conveying the recording medium in a first direction from the supply unit toward the image recording unit and in a second direction reverse to the first direction, with opposing the recording medium to the image recording unit;

a conveyance controller that controls the conveyance mechanism to convey the recording medium in the first direction until a leading edge of the recording medium reaches a position distant in the first direction from the image recording unit, and then convey the recording medium in the second direction;

an image recording controller that controls the image recording unit to record a plurality of frames of color images on the recording medium being conveyed in the second direction by the conveyance mechanism; and a cutting controller that controls the cutting unit to cut the recording medium being conveyed in the second direction by the conveyance mechanism, wherein the conveyance controller controls the conveyance mechanism to form a slack portion of the recording medium being conveyed in the second direction, between the image recording unit and the cutting unit, wherein the conveyance mechanism comprises:

a first pair of conveyance rollers that can pinch the recording medium between the cutting unit and the image recording unit and rotate to give a conveyance force to the recording medium; and a second pair of conveyance rollers that can pinch the recording medium between the cutting unit and the first pair of conveyance rollers and rotate to give a conveyance force to the recording medium, and the conveyance controller can control the first and second pairs of conveyance rollers independently of each other, a pressing member that can selectively takes a protruding position where the pressing member intersects a segment of a line extending between a contact point of the first pair of conveyance rollers and a contact point of the second pair of conveyance rollers, and a withdrawal position where the degree of protrusion of the pressing member beyond the segment is less than that at the protruding position;

a drive mechanism that moves the pressing member between the protruding position and the withdrawal position; and a position controller that controls the drive mechanism to move the pressing member to the protruding position when a length of the slack portion is not more than a predetermined length, and to the withdrawal position when the length of the slack portion is more than the predetermined length.

12. The printer according to claim 11, further comprising a detector capable of detecting a point on a convex portion of the slack portion having reached a predetermined position.

13. The printer according to claim 11, further comprising a stopper guide disposed on the same side of the segment extending between the contact point of the first pair of conveyance rollers and the contact point of the second pair of conveyance rollers, as a front end of the pressing member being at the protruding position, so as to be in contact with the slack portion and thereby guide the recording medium when the pressing member is at the protruding position.

* * * * *